US012558588B2

(12) United States Patent
Ho

(10) Patent No.: US 12,558,588 B2
(45) Date of Patent: Feb. 24, 2026

(54) PIVOT STOPPING MECHANISM

(71) Applicant: Willy Wei Yu Ho, Boyton Beach, FL (US)

(72) Inventor: Willy Wei Yu Ho, Boyton Beach, FL (US)

( * ) Notice: Subject to any disclaimer, the term of this patent is extended or adjusted under 35 U.S.C. 154(b) by 747 days.

(21) Appl. No.: 17/816,872

(22) Filed: Aug. 2, 2022

(65) Prior Publication Data

US 2022/0410140 A1 Dec. 29, 2022

Related U.S. Application Data

(63) Continuation-in-part of application No. 17/145,553, filed on Jan. 11, 2021, now Pat. No. 11,465,010.

(51) Int. Cl.
*A63B 26/00* (2006.01)
*A63B 21/00* (2006.01)

(52) U.S. Cl.
CPC ..... *A63B 21/4029* (2015.10); *A63B 26/00* (2013.01); *Y10T 403/32549* (2015.01)

(58) Field of Classification Search
CPC ..... A63B 21/4029; A63B 21/08; A63B 26/00; A63B 2210/50; A63B 2210/54; A63B 2210/56; A63B 2225/09; Y10T 403/32549; Y10T 403/32557; Y10T 403/32591
See application file for complete search history.

(56) References Cited

U.S. PATENT DOCUMENTS 1,675,718 A * 7/1928 Lynch ..... D06F 93/00 40/657
2,845,317 A * 7/1958 Orman ..... A47B 3/12 248/164
2,874,613 A * 2/1959 Bogar, Jr. ..... A47B 67/005 248/479
4,936,572 A * 6/1990 Desiderio ..... A63B 21/078 482/142
5,456,790 A * 10/1995 Yu Chen ..... B65H 35/0033 156/577
5,474,404 A * 12/1995 Chien ..... A47D 13/063 5/98.1
5,531,658 A * 7/1996 L. S. C. ..... A63B 23/0222 482/142
5,685,660 A * 11/1997 Liao ..... E05D 11/1007 384/585
5,906,014 A * 5/1999 Zhuang ..... A47D 13/063 5/98.1
5,928,116 A * 7/1999 Chiang ..... A63B 21/4047 482/133
5,954,619 A * 9/1999 Petrone ..... A63B 71/0036 482/106
5,964,545 A * 10/1999 Cheng ..... A47D 13/063 5/98.1

(Continued)

*Primary Examiner* — Amber R Anderson
*Assistant Examiner* — Kevin J Baynes
(74) *Attorney, Agent, or Firm* — WOMBLE BOND DICKINSON (US) LLP

(57) ABSTRACT

According to aspects of the present disclosure, a seat of an exercise bench may be repositioned (e.g., raised and rotated) to function as an elbow or arm rest for various weightlifting exercises (referred to as the "deployed position"). The repositioning of the seat (or arm rest) is achieved with a pivot stopping mechanism that securely limit the desired reposition angle and location during adjustment.

10 Claims, 21 Drawing Sheets

(56) References Cited

U.S. PATENT DOCUMENTS

| | | | | |
|---|---|---|---|---|
| 6,001,051 | A * | 12/1999 | Chuan-Pin | A63B 21/0552 482/142 |
| 6,447,433 | B1 * | 9/2002 | Reyes | A63B 21/078 482/104 |
| 7,322,912 | B2 * | 1/2008 | Hockemeyer | A63B 21/078 482/142 |
| 7,712,761 | B2 * | 5/2010 | Mater, Jr. | B60D 1/50 280/441 |
| 7,753,830 | B1 * | 7/2010 | Marsh | A63B 23/03525 482/142 |
| 9,101,792 | B2 * | 8/2015 | Ho | A63B 23/0211 |
| 9,944,137 | B2 * | 4/2018 | Curl | B62D 53/0828 |
| D933,762 | S | 10/2021 | Wang | |
| 11,717,715 | B2 * | 8/2023 | Sergakis | A63B 21/078 482/104 |
| 2003/0134730 | A1 | 7/2003 | Deola | |
| 2005/0197238 | A1 | 9/2005 | Parker | |
| 2006/0035772 | A1 | 2/2006 | Golesh et al. | |
| 2006/0122045 | A1 | 6/2006 | Webber | |
| 2019/0151699 | A1 | 5/2019 | Isom | |
| 2020/0261759 | A1 * | 8/2020 | Downing | A63B 21/0783 |

* cited by examiner

PIVOT STOPPING MECHANISM

CROSS REFERENCE TO COPENDING APPLICATIONS

This application is a continuation-in-part (CIP) patent application of U.S. patent application Ser. No. 17/145,533, entitled "FOLDABLE EXERCISE BENCH," filed on Jan. 11, 2021, which is incorporated herein in the entirety.

FIELD

The disclosed embodiments relate generally to exercise equipment and in particular, but not exclusively, to a pivot stopping mechanism thereof.

BACKGROUND

Many exercise activities require specialized equipment that can be quite bulky and, currently, much exercise equipment is not easily collapsed for storage. Most exercise equipment is also not attractive as a piece of furniture and not useful for much other than its intended function. Before buying current exercise equipment, then, a buyer must have a dedicated space for using and storing the exercise equipment. But this is often not feasible, especially for people who live in small houses or apartments. One alternative is to join a fitness club and use its exercise equipment, but that can be expensive and people often don't want the multi-year commitment fitness clubs can entail.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 1A is an exploded perspective view; FIG. 1B is an assembled perspective view;

FIGS. 1C-1D are top and bottom plan views, respectively; and FIGS. 1E-1F are side and front views, respectively.

FIG. 2A is a perspective view, FIG. 2B a side view.

FIG. 3A is a perspective view, FIG. 3B a side view.

FIG. 5A is a perspective view during folding of the rear leg; FIGS. 5B-5C are perspective views of the folded configuration; and FIG. 5D is a side view of the folded configuration.

Like numerals indicate like elements.

DETAILED DESCRIPTION

Figure 1A:
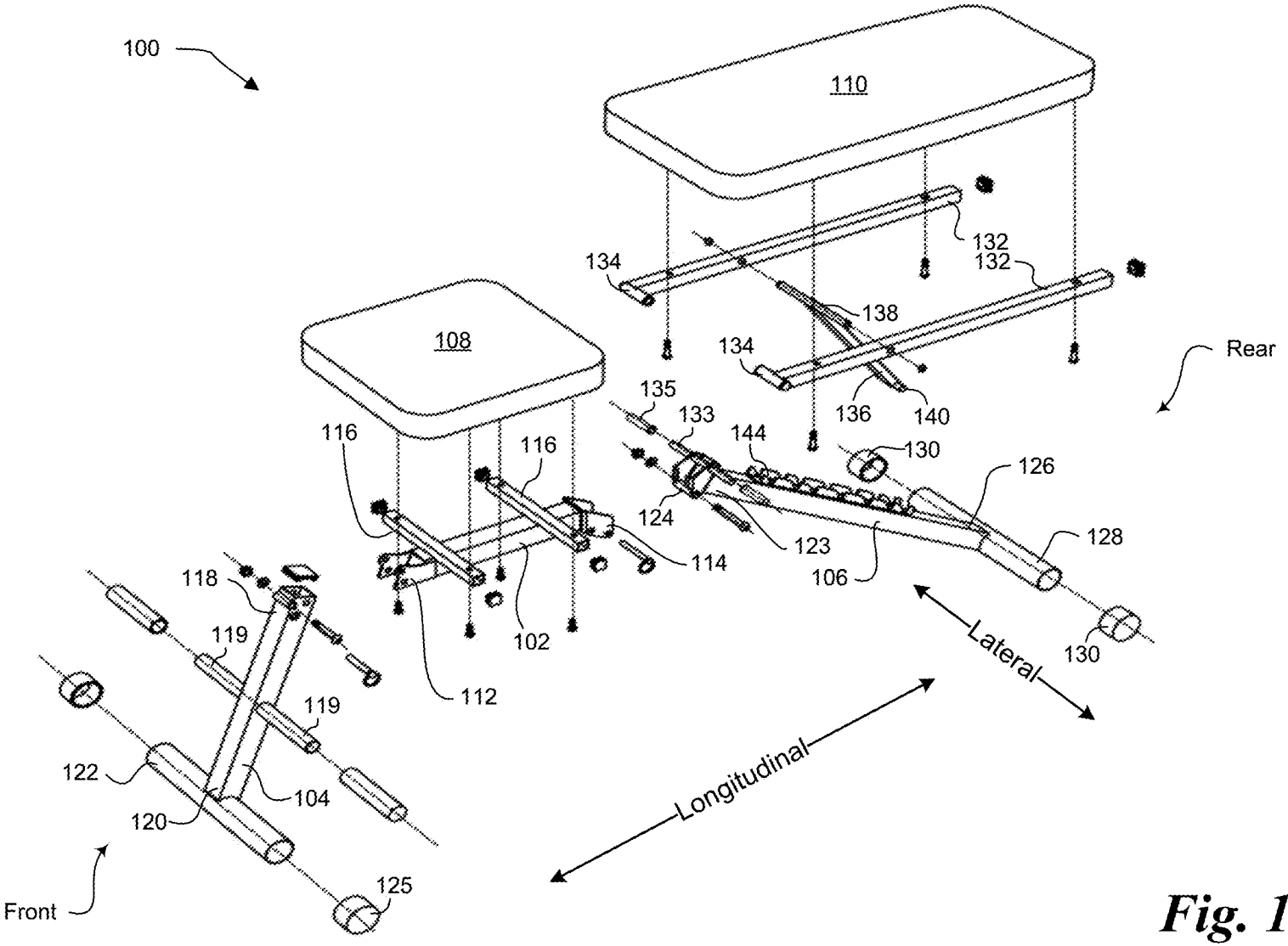
FIGS. 1A-1F are drawings of an embodiment of a foldable exercise bench in a deployed configuration.

Embodiments are described of a pivot stopping mechanism, such as one used in a foldable exercise bench and may be used in other different applications. Specific details are described to provide an understanding of the embodiments, but one skilled in the relevant art will recognize that the invention can be practiced without one or more of the described details or with other methods, components, materials, etc. In some instances, well-known structures, materials, or operations are not shown or described in detail but are nonetheless encompassed within the scope of the invention.

Reference throughout this specification to "one embodiment" or "an embodiment" means that a described feature, structure, or characteristic can be included in at least one described embodiment, so that appearances of "in one embodiment" or "in an embodiment" do not necessarily all refer to the same embodiment. As used in this application, directional terms such as "front," "rear," "top," "bottom," "side," "lateral," "longitudinal," etc., refer to the orientations of embodiments as they are presented in the drawings, but any directional terms should not be interpreted to imply or require any particular orientation of the described embodiments when in actual use. Furthermore, the particular features, structures, or characteristics may be combined in any suitable manner in one or more embodiments.

Exercise benches provide users a secure seating platform to allow the users to train specific muscle groups in specific positions. Often, exercise benches allow for adjustments of seating angles for different exercise types or intensities. Such exercise benches include multiple pivots or hinged joints that connect links to be secured at different locations. Traditional work benches may use a removable pin to secure the relative positions between links, by inserting the links to corresponding aligned holes. Although effective, such assembly method may be cumbersome and time-consuming. The present disclosure provides a pivot stopping mechanism free from assembly and simple to adjust part of an exercise bench to a preset angle or position.

According to aspects of the present disclosure, a seat of an exercise bench may be repositioned (e.g., raised and rotated) to function as an elbow or arm rest for various weightlifting exercises (referred to as the "deployed position"). The repositioning of the seat (or arm rest) is achieved with a pivot stopping mechanism that securely limit the desired reposition angle and location during adjustment. In particular, no assembly or adjustment (such as using pins or locking movable parts) is required when securing the seat at the deployed position. This greatly simplifies operation and incentivize using different modes of the exercise bench.

In an embodiment, the pivot stopping mechanism may be implemented as a linkage (such as a four-bar linkage). The pivot stopping mechanism may include a base structure that has a first pivot and a second pivot. The pivot stopping mechanism includes a first linkage made from a first plate. For example, the first plate is bent to form an elongated shape as the first linkage. The first linkage may include a first tab of the first plate bent to form a first angle with an unbent portion of the first plate. The first tab forms a first crease with the unbent portion of the first plate. The first tab may have a first cavity and a second cavity. The first cavity rotationally engages the first pivot of the base structure. The second cavity rotationally engages a third pivot of a third linkage. The first linkage is configured to rotate about the first pivot between a first position and a second position.

The first linkage further includes a second tab of the first plate bent to form a second angle with the unbent portion of the first plate. The second tab forms a second crease with the unbent portion of the first plate. The second crease forms a non-zero angle with the first crease. The second tab provides a first flat surface for engaging the base structure at the second position.

The linkage mechanism includes a second linkage that includes a third cavity and a fourth cavity. The third cavity rotationally engages the second pivot of the base structure. The fourth cavity rotationally engaging a fourth pivot of the third linkage. The third linkage is movable between a default position and a set position respectively corresponding to the first linkage being at the first position and the second position. For example, a seat or arm rest may be attached to the third linkage to be positioned at the default position or the set position.

In an embodiment, the pivot stopping mechanism may be implemented as a stopper. The stopper includes a first tab of the plate bent to form a first angle with an unbent portion the plate. The first tab forms a first crease with the unbent portion of the plate and has a cavity for rotationally engaging a pivot of a base structure so that the pivot stopper is configured to rotate around the pivot between a first position and a second position. For example, the first position may correspond to a storage or transportation mode and the second position may correspond to a deployed mode. The stopper may include a second tab of the plate bent to form a second angle with the unbent portion of the plate. The second tab provides a flat surface for engaging the base structure at the second position.

Figure 1B:
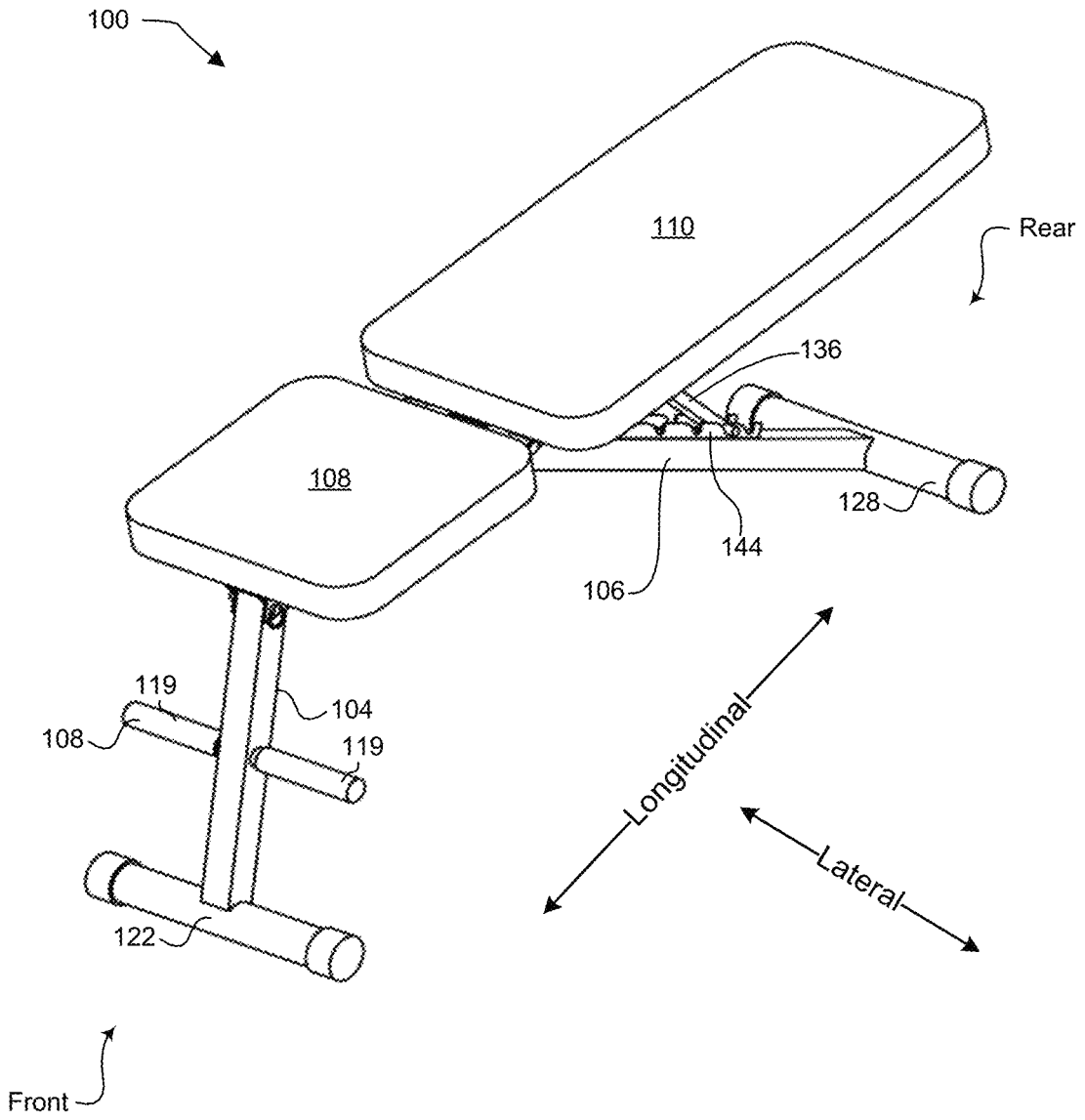
Figure 1C:
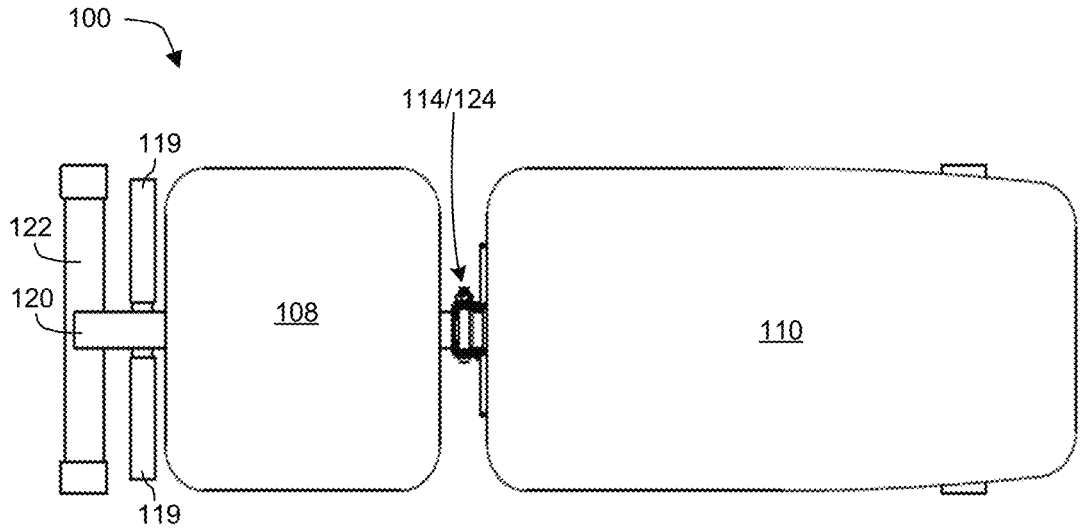
Figure 1D:
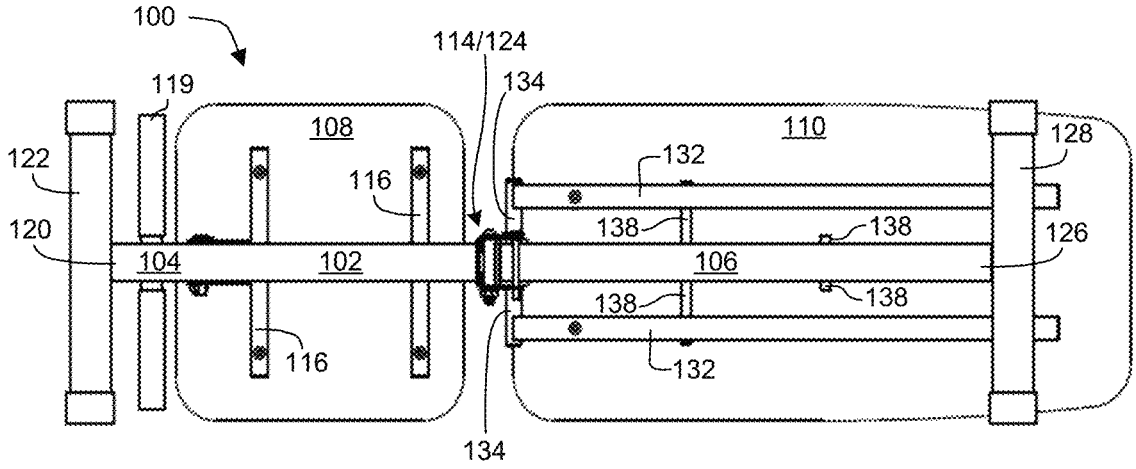
Figure 1E:
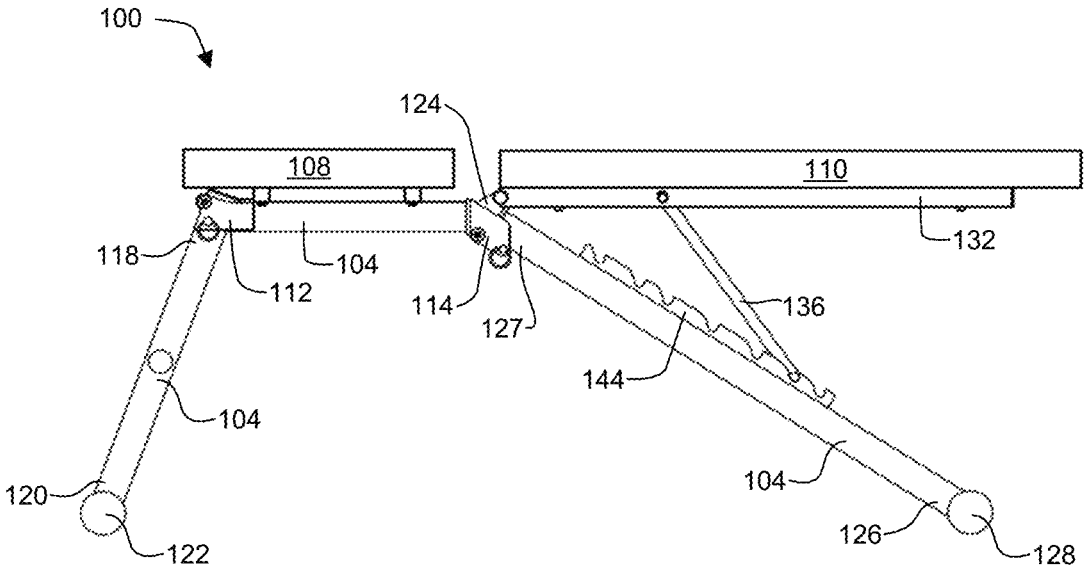
Figure 1F:
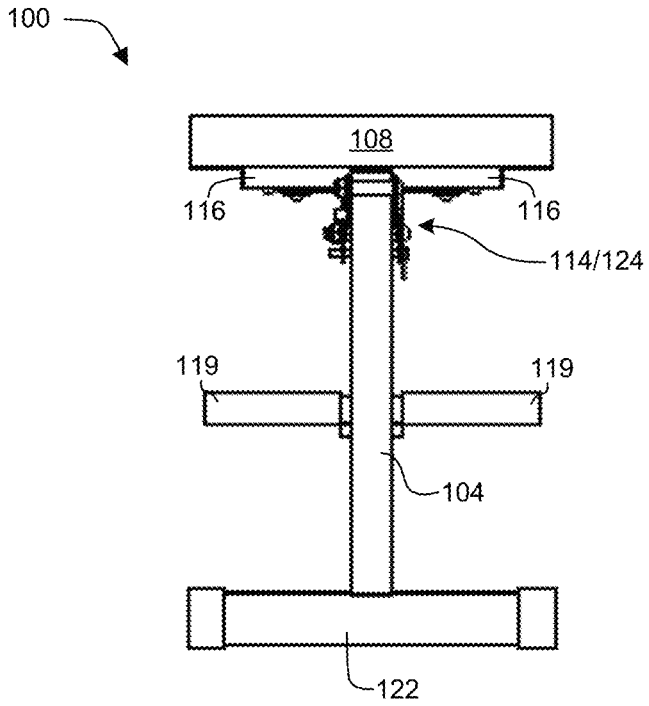

FIGS. 1A-1F together illustrate an embodiment of a foldable exercise bench 100. FIG. 1A is an exploded perspective view; FIG. 1B is an assembled perspective view; FIGS. 1C-1D are top and bottom plan views, respectively; and FIGS. 1E-1F are side and front views, respectively.

Foldable exercise bench 100 has a frame that includes a girder 102, a front leg 104, and a rear leg 106. A seat 108 is positioned on girder 102 and a back rest 110 with a variable angle relative to girder 102 is attached to a rear end of the girder. In the illustrated embodiment, girder 102, front leg 104, and rear leg 106 are hollow members with a quadrilateral cross-sectional shape, but in other embodiments the girder, front leg, and rear leg can have other cross-sectional shapes and need not be hollow. In still other embodiments, the girder, front leg, and rear leg need not have the same build or cross-sectional shape.

Girder 102 has a first fitting 112 attached to its front end and a second fitting 114 attached to its rear end. A pair of substantially parallel spaced-apart rails 116 are mounted to girder 102, and a seat 108 is then mounted to the rails. In other embodiments, seat 108 can be coupled to girder 102 differently than shown; for instance, seat 108 can be coupled to girder 102 with a structure different than rails 116, or can be directly mounted onto girder 102 without any intervening structure. First fitting 112 and second fitting 114 are further described below in connection with FIGS. 2A-2B and 3A-3B.

Front leg 104 has a proximal end 118 and a distal end 120. Distal end 120 has a foot 122 that extends perpendicular to front leg 104 and to either side of front leg 104. When exercise bench 100 is deployed, foot 122 stabilizes the bench and prevents it from tipping laterally. In the illustrated embodiment foot 122 is hollow and has a circular cross-sectional shape, but in other embodiments it need not be hollow and can have a different cross-sectional shape than shown. End caps 125 can be positioned on the ends of foot 122 both for aesthetic reasons and, if the end caps 125 are made of a material such as rubber, to keep bench 100 from sliding laterally or longitudinally across the floor when in use. Front leg 104 is coupled to girder 102 by inserting proximal end 118 into fitting 112 and inserting the required pins and bolts, as described below in connection with FIGS. 2A-2B. Front leg 104 can also include foot rests 119 on which a user sitting on seat 108 can rest their feet or hook their ankles when using the exercise bench.

Rear leg 106 includes a proximal end 123 and a distal end 126. As with front leg 104, distal end 126 has a foot 128 that extends perpendicular to rear leg 106 and to either side of the rear leg. When exercise bench 100 is deployed, foot 128, acting together with foot 122, stabilizes the bench and prevents it from tipping laterally. In the illustrated embodiment foot 128 is hollow and has a circular cross-sectional shape, but in other embodiments it need not be hollow and can have a different cross-sectional shape. End caps 130 can be positioned on the ends of foot 128 both for aesthetic reasons and, if end caps 130 are made of a material such as rubber, to keep bench 100 from sliding laterally or longitudinally during use.

A pivot stopper 124 is positioned on proximal end 123 of leg 106. Rear leg 106 is coupled to girder 102 by coupling the pivot stopper 124 to fitting 114, as further described below in connection with FIGS. 2A-2B. Rear leg 106 also includes a pair of rails 144 positioned on an upper side thereof. Each pair of rails 144 includes aligned pairs of notches that define detents for adjusting the angular position of backrest 110.

Backrest 110 is coupled to a pair of substantially parallel spaced-apart rails 132 attached to its back side. Each rail 132 includes a cylindrical sleeve 134 at one of its ends, with each cylindrical sleeve being substantially perpendicular to an axis of its corresponding rail. Backrest 110 is coupled to girder 102 and rear leg 106 by coupling circular sleeves 134 to the pivot stopper 124 using rod 133 and sleeves 135 (e.g., bushings). To allow adjustment of the backrest angle (i.e., the angle of backrest 110 relative to seat 108 and/or girder 102), circular sleeves 134 are rotatably attached to the pivot stopper 124—i.e., circular sleeves 134 are attached to the pivot stopper 124 so that backrest 110 can rotate about rod 133, thus allowing the angle of backrest 110 relative to seat 108 to be adjusted. A positioning strut 136 includes a transverse portion 138 that is rotatably coupled to both rails 132 and also includes a transverse portion 140 that can be inserted into the detents formed by the notch pairs in rails 144. Thus, backrest 110 can rotate about the pivot stopper 124, and it is held at a desired angle by inserting transverse member 140 into the appropriate pair of detents in rails 144.

Figure 2A:
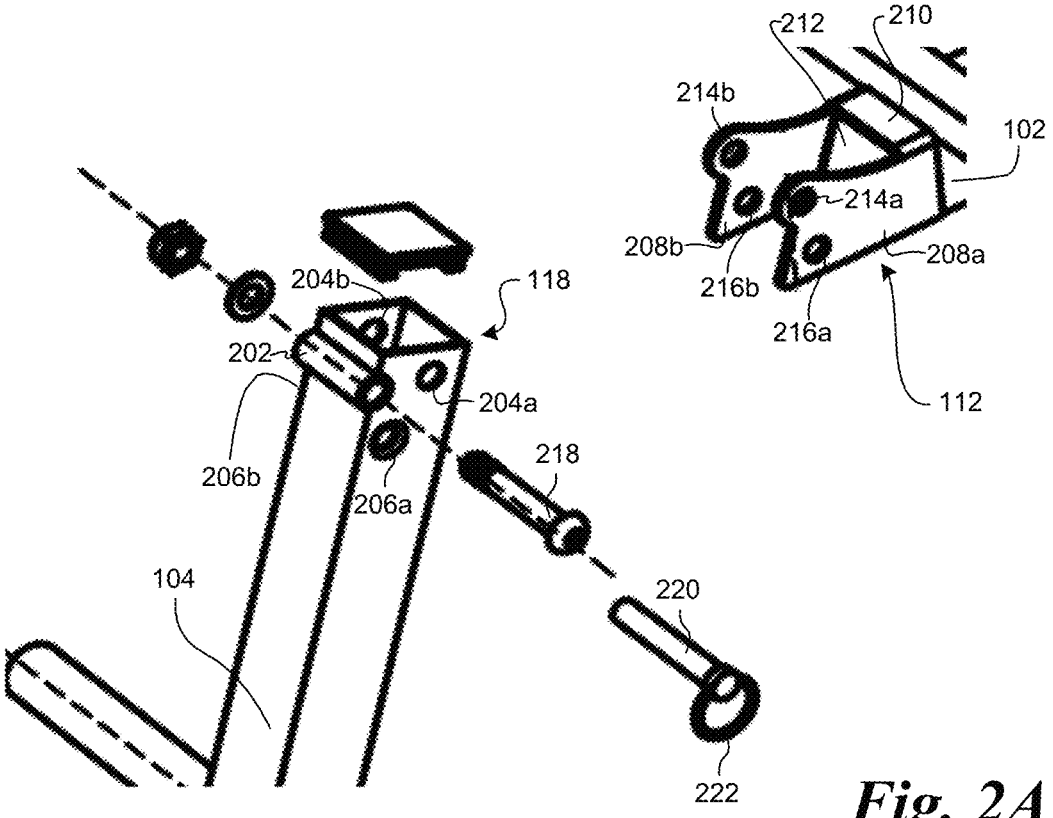
FIGS. 2A-2B are drawings of an embodiment of a fitting for coupling the girder to the front leg.
Figure 2B:
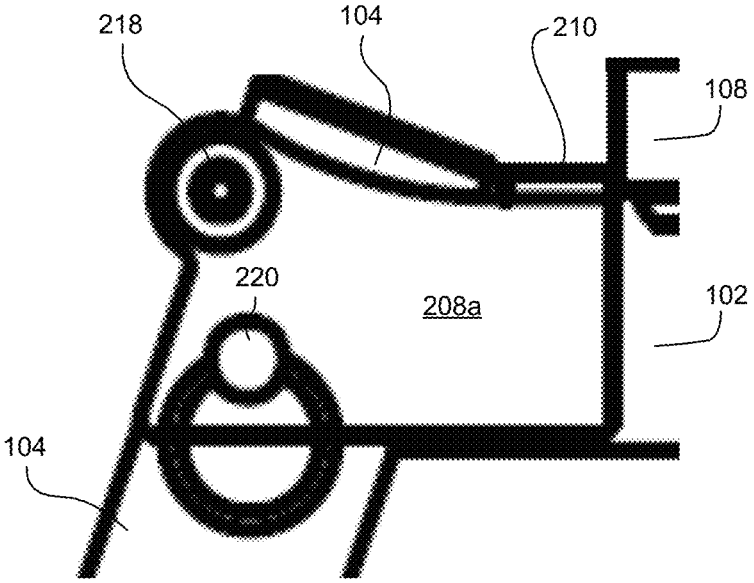

FIGS. 2A-2B together illustrate an embodiment of first fitting 112 for coupling front leg 104 to girder 102. FIG. 2A is a perspective view, FIG. 2B a side view. Front leg 104 includes a cylindrical sleeve 202 attached to a surface of the front leg, as well as two aligned hole pairs 204 and 206. Each hole pair 204 and 206 includes two aligned holes (i.e., two holes through which a faster or other straight member can be inserted) positioned in opposite sides of leg 104: hole pair 204 includes hole 204*a* in one side of leg 104 and aligned hole 204*b* in the opposite side of leg 104, and hole pair 206 includes hole 206*a* in the same side of leg 104 as hole 204*a* and an aligned hole 206*b* in leg 104 directly opposite hole 206*a*. Hole 206*b* in not visible in the view of FIG. 2A.

Fitting 112 includes a pair of laterally spaced-apart flanges 208*a* and 208*b*, both of which are coupled to a base 210 that is in turn coupled to the front end of girder 102. Base 210 includes a flat surface 212 that will be flush against one side of front leg 104 when the front leg is in its deployed position. The lateral spacing between flanges 208*a* and 208*b* is large enough to accommodate a dimension of front leg 104, in this case its lateral width. Flanges 208 includes two aligned hole pairs 214 and 216: aligned hole pair 214 includes hole 214*a* in flange 208*a* and hole 214*b* in flange 208*b*, while aligned hole pair 216 includes hole 216*a* in flange 208*a* and hole 216*b* in flange 208*b*.

To connect front leg 104 to girder 102, its proximal end 118 is inserted into fitting 112 between flanges 208*a* and 208*b* so that sleeve 202 aligns with hole pair 214. A bolt 218 is inserted into hole 214*a*, through sleeve 202, and out hole 214*b*, where a nut is attached to the end of the bolt and tightened to keep the bolt in place. Once bolt 218 is secured in place, front leg 104 can rotate about the bolt between a deployed position and a stored position. In the deployed position, a side of front leg 104 is brought flush with surface 212, at which point hole pair 206 in front leg 104 aligns with hole pair 216 in flanges 208. A pin 220 can then be inserted through holes 216*a*, 206*a*, 206*b*, and 216*b* to prevent rotation of front leg 104 about bolt 218, thus locking the front leg in its deployed configuration (see, e.g., FIGS. 1B-1F). Hole pair 206, including holes 206*a* and 206*b*, can thus be considered a "deployment hole," since the hole pair is used to lock front leg 104 is its deployed position. To change exercise bench 100 from its deployed position to its stored or folded configuration, front leg 104 is rotated about bolt 218 until hole pair 204 of the front leg aligns with hole pair 216 of the flanges, at which point the front leg will be in its stored position. Pin 220 can then be inserted through holes 216*a*, 204*a*, 204*b*, and 216*b* to prevent rotation of front leg 104 about bolt 218, thus locking the front leg in its stored or folded position (see, e.g., FIGS. 6A-6C). Hole pair 204, including holes 204*a* and 204*b*, can thus be considered a "storage hole," since the hole pair is used to lock front leg 104 is its stored position. The pin 220 may be attached to a ring 222 for ease of removal.

Figure 3A:
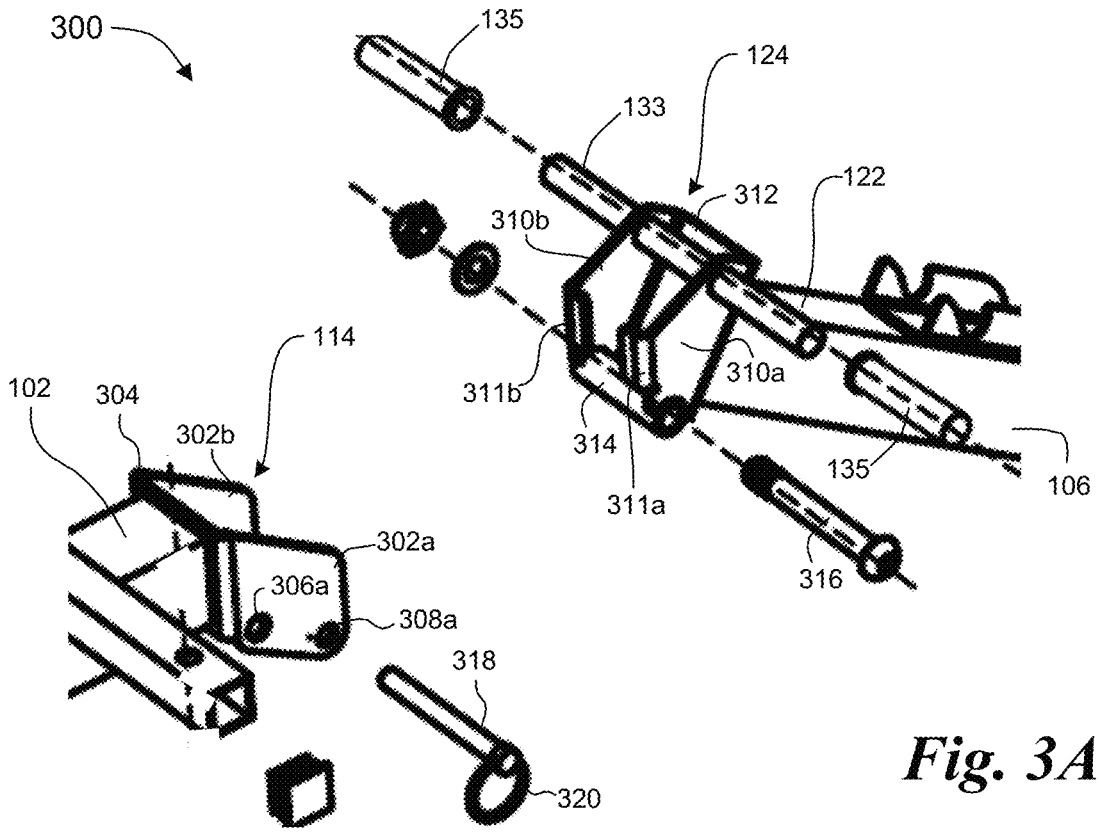
FIGS. 3A-3B are drawings of an embodiment of a fitting for coupling the girder to the rear leg.
Figure 3B:
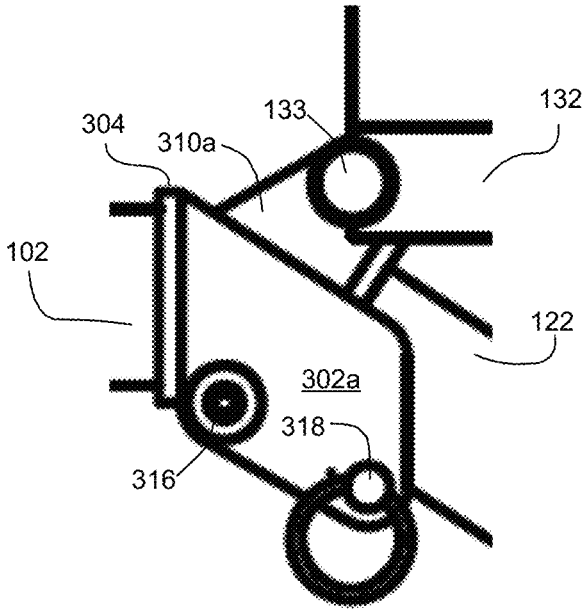

FIGS. 3A-3B together illustrate an embodiment of a fitting 300 for coupling girder 102 to rear leg 106. FIG. 3A is a perspective view, FIG. 3B a side view. Fitting 300 includes two parts: a fitting 114 coupled to the rear end of girder 102, and another the pivot stopper 124 coupled to the proximal end of rear leg 106.

Fitting 114 includes a pair of laterally spaced-apart flanges 302*a* and 302*b*, both of which are coupled to base 304. Base 304 is in turn coupled to the rear end of girder 102. The lateral spacing between flanges 302*a* and 302*b* is sized to accommodate a dimension of the pivot stopper 124, in this case its lateral width. Flanges 302 includes two aligned hole pairs 306 and 308—that is, each flange 302 includes a pair of holes, and each hole in each flange has a corresponding aligned hole in the other flange. Thus, aligned hole pair 306 includes hole 306*a* in flange 302*a* and hole 306*b* in flange 302*b*, and aligned hole pair 308 includes hole 308*a* in flange 302*a* and hole 308*b* in flange 302*b*. Holes 306*b* and 308*b* are not visible in the figure.

The pivot stopper 124 is coupled to a proximal end 123 of rear leg 106. This fitting includes a pair of laterally spaced-apart flanges 310*a* and 310*b* coupled to a base 312. In the illustrated embodiment flanges 310*a*-310*b* have a substantially pentagonal shape, but in other embodiments they can have other shapes. Each flange includes an inwardly-projecting tab 311 (i.e., a tab projecting toward the other flange): flange 310*a* includes tab 311*a* and flange 310*b* includes tab 311*b*. Base 312 is coupled to the distal end 127 of rear leg 106. Base 312 and both flanges 310*a* and 310*b* are coupled to a cylindrical sleeve 314 at one end. At or near an end of the pivot stopper 124 opposite sleeve 314, rod 133 extends through a pair of aligned holes in flanges 310*a* and 310*b*. Sleeves 135 slide onto rod 133 to allow attachment of cylindrical sleeves 314 of rails 132 to rod 133 (see FIG. 1A).

To connect rear leg 106 to girder 102, the pivot stopper 124 is inserted into fitting 114 between flanges 302*a* and 302*b*, so that cylindrical sleeve 314 aligns with hole pair 306—i.e., holes 306*a* and 306*b*. A bolt 316 is inserted into hole 306*a*, through sleeve 314, and out hole 306*b*, where a nut is attached to the end of the bolt and tightened to keep the bolt in place. Once bolt 316 is secured in place, rear leg 106 can rotate about bolt 316 between a deployed position and a folded or stored position. In the deployed position, tabs 311*a* and 311*b* are brought flush with base 304 of fitting 114, at which point hole pair 308 in flanges 302 aligns with a lower surface of rear leg 106. A pin 318 can then be inserted through holes 308*a* and 308*b*, so that the pin is in contact with a lower surface of rear leg 106 and prevents rotation of rear leg 106 about bolt 316, thus locking the front leg in its deployed position (see, e.g., FIGS. 1B-1F). To change exercise bench 100 from its deployed position to its stored or folded position, pin 318 is removed and rear leg 106 is rotated about bolt 316 until rear leg 106 is substantially parallel to girder 102, at which point the rear leg will be in its stored position. Pin 318 is then inserted through holes 308*a* and 308*b*, which are then flush with flanges 310*a*-310*b*, to prevent rotation of rear leg 106 about bolt 316, thus locking the rear leg in its stored or folded position (see, e.g., FIGS. 6A-6C). Hole pair 308, including holes 308*a* and 308*b*, can thus be considered both a "deployment hole" and a "storage hole," since the hole pair is used to lock rear leg 106 in both its deployed and stored positions. The pin 318 may be attached to a ring 320 for ease of removal.

Figure 4A:
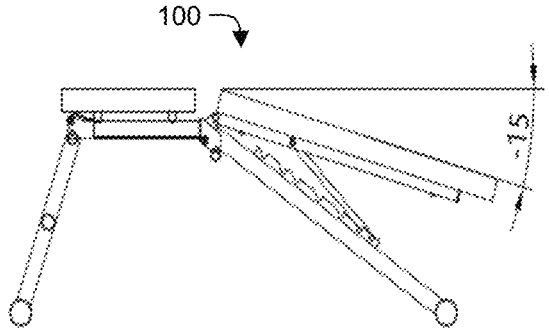
FIGS. 4A-4G are side-views of an embodiment of a foldable exercise bench in its deployed configuration with its backrest positioned at different backrest angles.
Figure 4B:
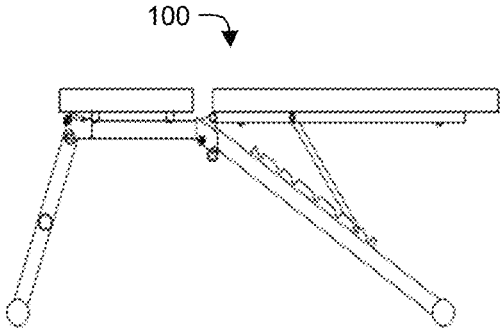
Figure 4C:
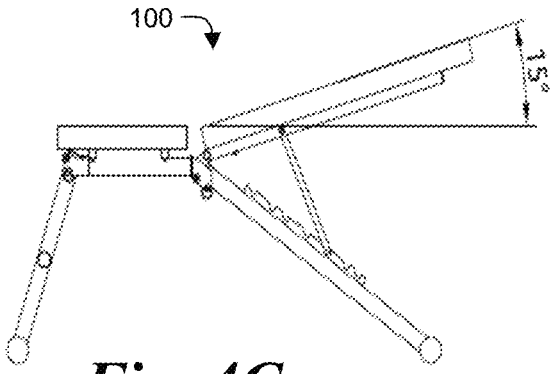
Figure 4D:
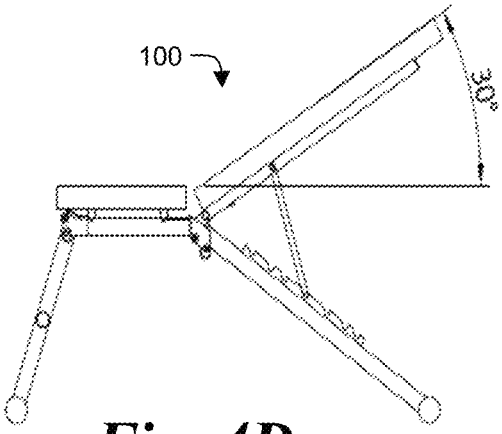
Figure 4E:
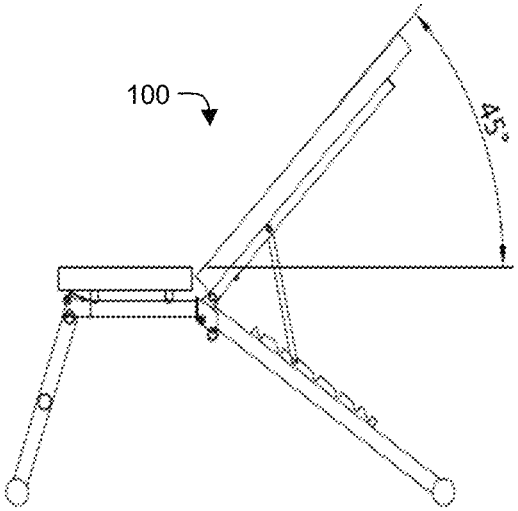
Figure 4F:
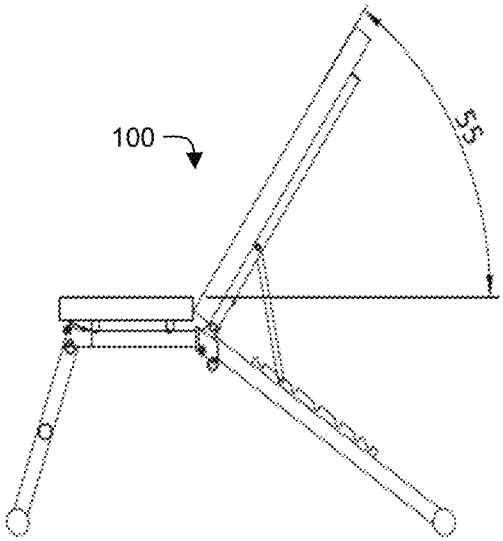
Figure 4G:
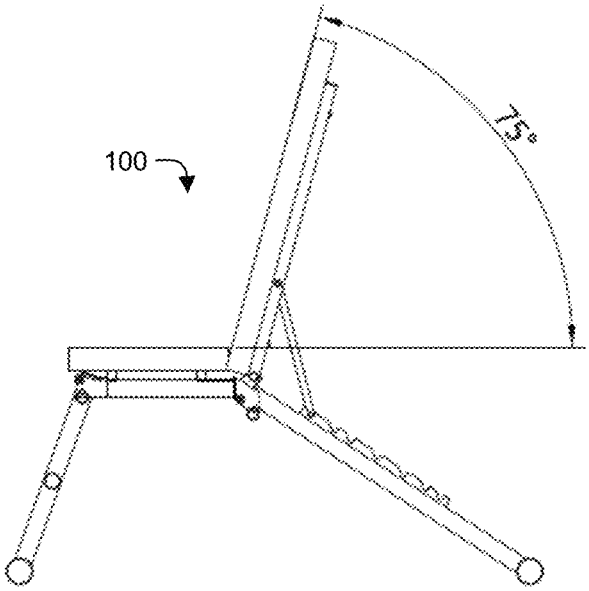

FIGS. 4A-4G illustrate how the backrest angle (the angle of backrest 110 relative to seat 108 or girder 102) can be adjusted in an embodiment of exercise bench 100. As previously explained, rails 132 include sleeves 134 that rotate about rod 133. As a result, the backrest angle is variable. In the illustrated embodiment, the backrest angle can take on values from −15 degrees (FIG. 4A) to +75 degrees (FIG. 4G). The number of discrete backrest angles at which the backrest can be fixed depends largely on the number of detents—i.e., on the number of aligned notch pairs in rails 144. In the illustrated embodiment, the backrest can be fixed at seven different angles: −15 degrees (FIG. 4A), 0 degrees (FIG. 4B), +15 degrees (FIG. 4C), +30 degrees (FIG. 4D), +45 degrees (FIG. 4E), +55 degrees (FIG. 4F) and +75 degrees (FIG. 4G). A particular backrest angle is maintained by inserting transverse portion 140 of positioning strut 136 into the appropriate aligned notch pair in rails 144—that is, in the appropriate detents. Generally, the higher the backrest angle, the closer to girder 102 will be the detent used to receive transverse portion 140. Other embodiments of exercise bench 100 can of course have more or less detents than shown and can have detents positioned to implement different backrest angles than shown.

Figure 5A:
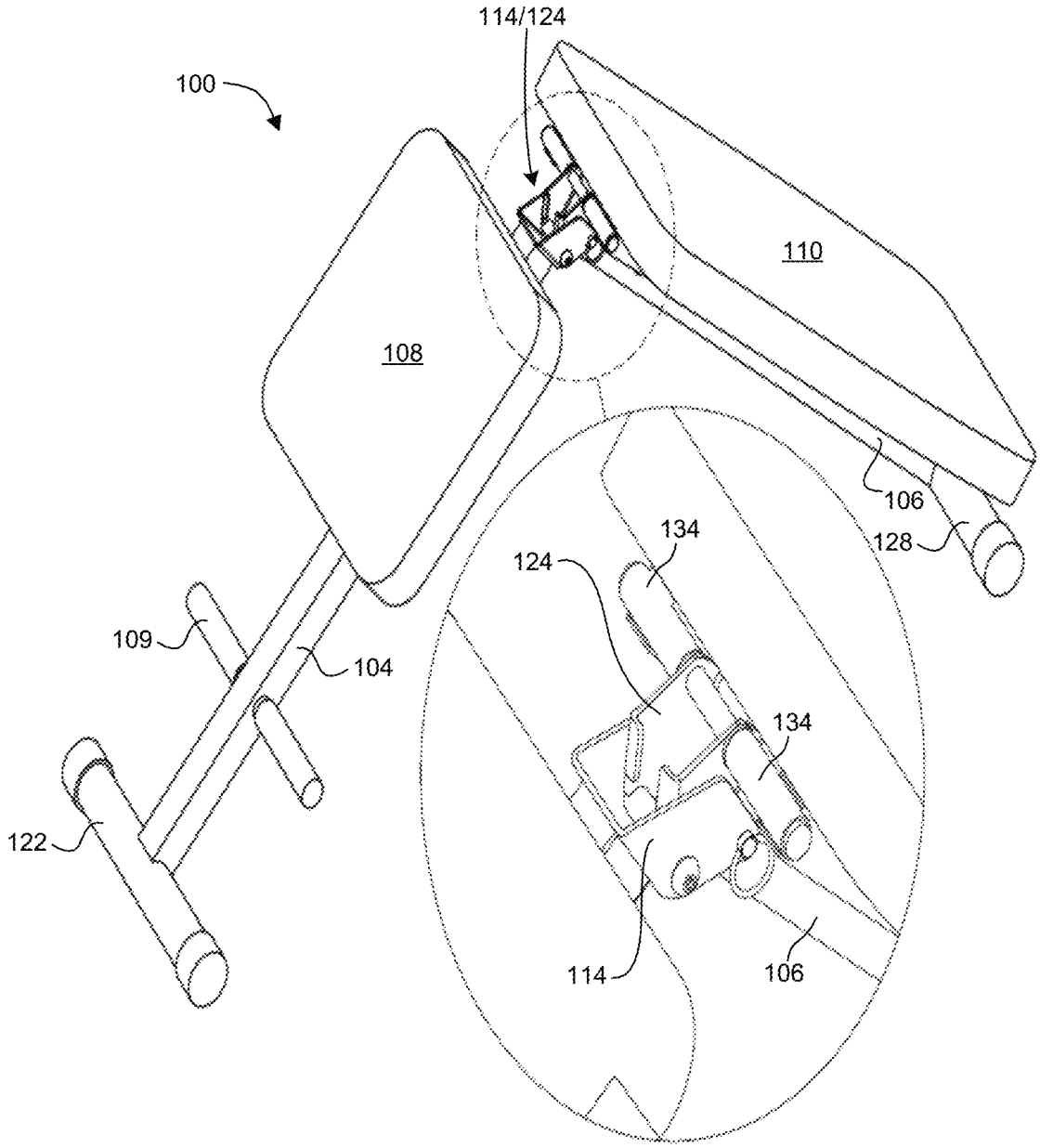
FIGS. 5A-5D together are drawings of an embodiment of a foldable exercise bench during folding and in its folded configuration.
Figure 5B:
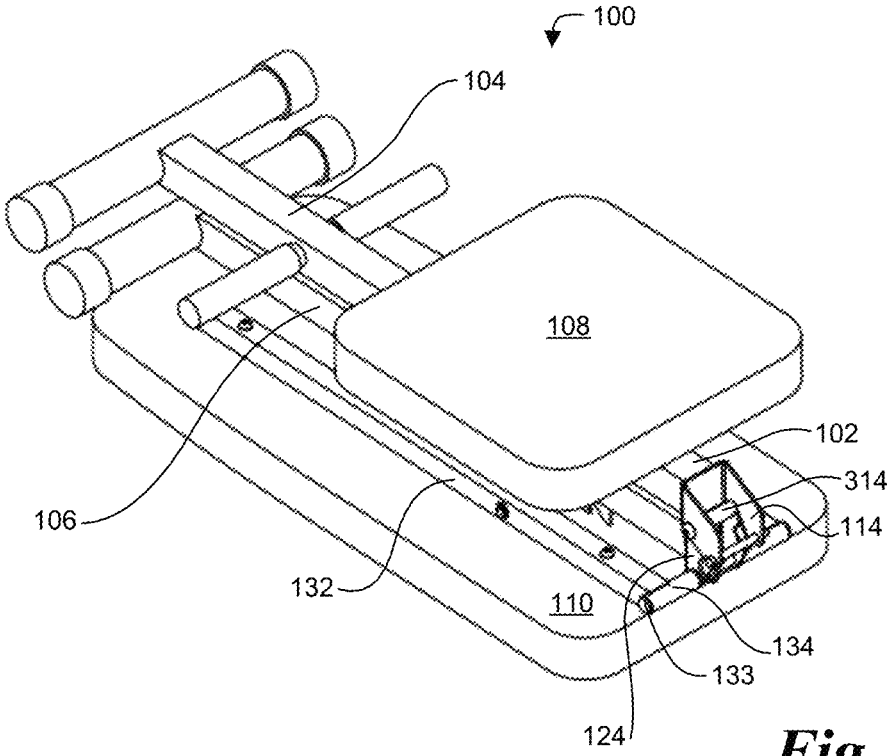
Figure 5C:
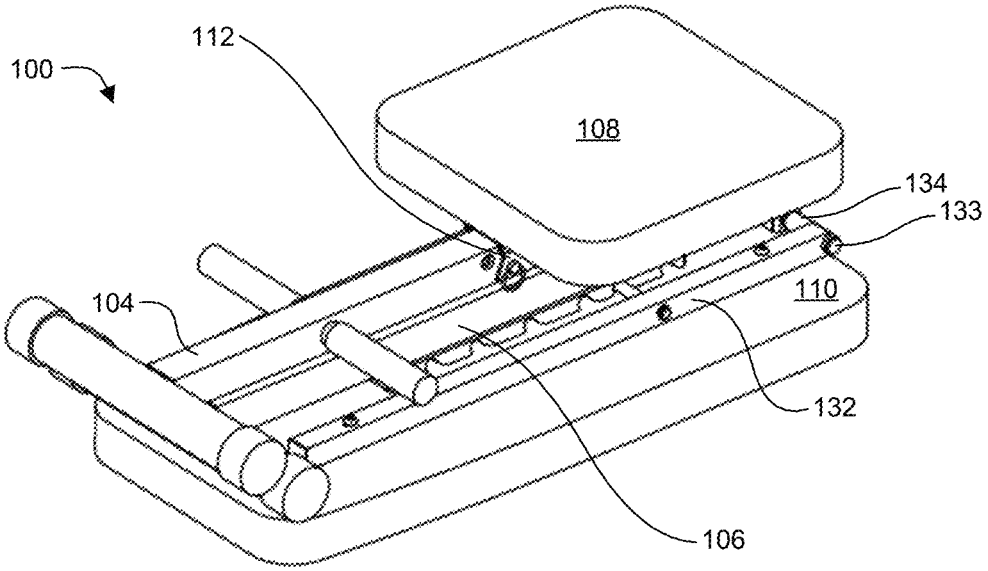
Figure 5D:
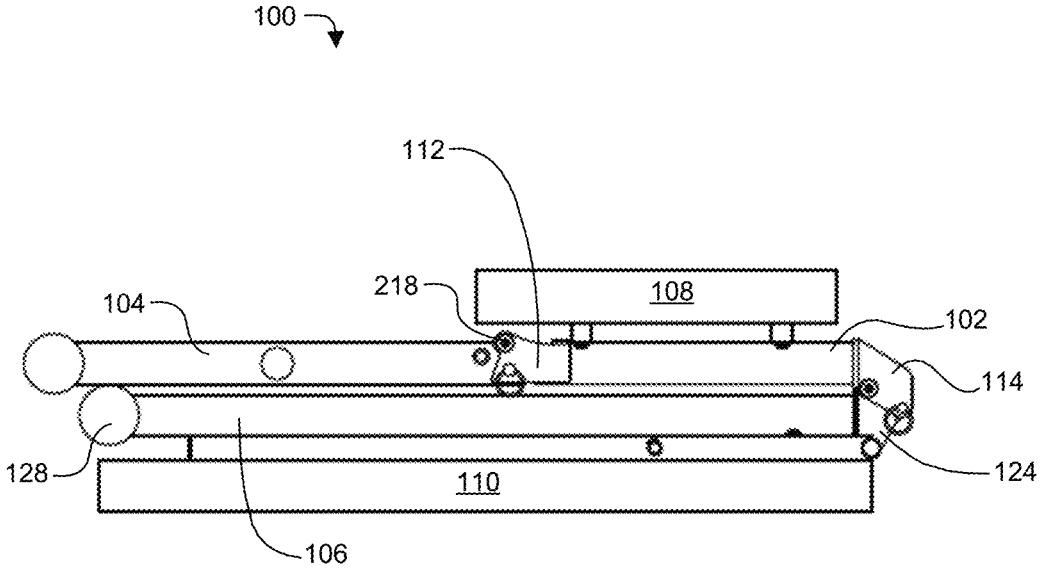

FIGS. 5A-5D together illustrate an embodiment of foldable exercise bench 100 during folding and in its folded or stored configuration. FIG. 5A is a perspective view during folding of rear leg 106, FIGS. 5B-5C are perspective view of the folded configuration, and FIG. 5D is a side view of the folded configuration. In the folded or stored configuration, front leg 104 is rotated about bolt 218 as described above for FIGS. 2A-2B until it is substantially aligned with girder 102. When front leg 104 substantially aligns with the girder, holes 204*a* and 204*b* align with holes 216*a* and 216*b*, respectively. Pin 220 can then be inserted through holes 216*a*, 204*a*, 204*b*, and 216*b* to prevent rotation of front leg 104 about bolt 218, thus locking the front leg in its stored position. In the folded or stored configuration, rear leg 106 is rotated about bolt 316 until its foot 128 is in contact with stored front leg 104, at which point rear leg 106 will be substantially parallel to front leg 104 and girder 102, with a small separation between the rear leg and the front leg and girder. Positioning strut 136 is disengaged from any detents in rails 132, and sleeves 134 rotate about the rod 133 (e.g., a pivot) so that rails 132 end up on either side of, and substantially parallel to, rear leg 106. The result is a compact folded configuration. The front leg may include a bar 109 for limiting leg movements of a user.

FIGS. 6A-6F illustrate an example of a foldable exercise bench (similar to the foldable exercise bench 100 of FIG. 1) with an adjustable arm rest 608, in accordance with aspects of the present disclosure. Instead of the fixed seat 108, the adjustable arm rest 608 can be positioned in both a default position functioning as the fixed seat, and raised to an upward position for receiving elbows or arms of a user during weightlifting (while the backrest 110 functions as the seat).

Figure 6A:
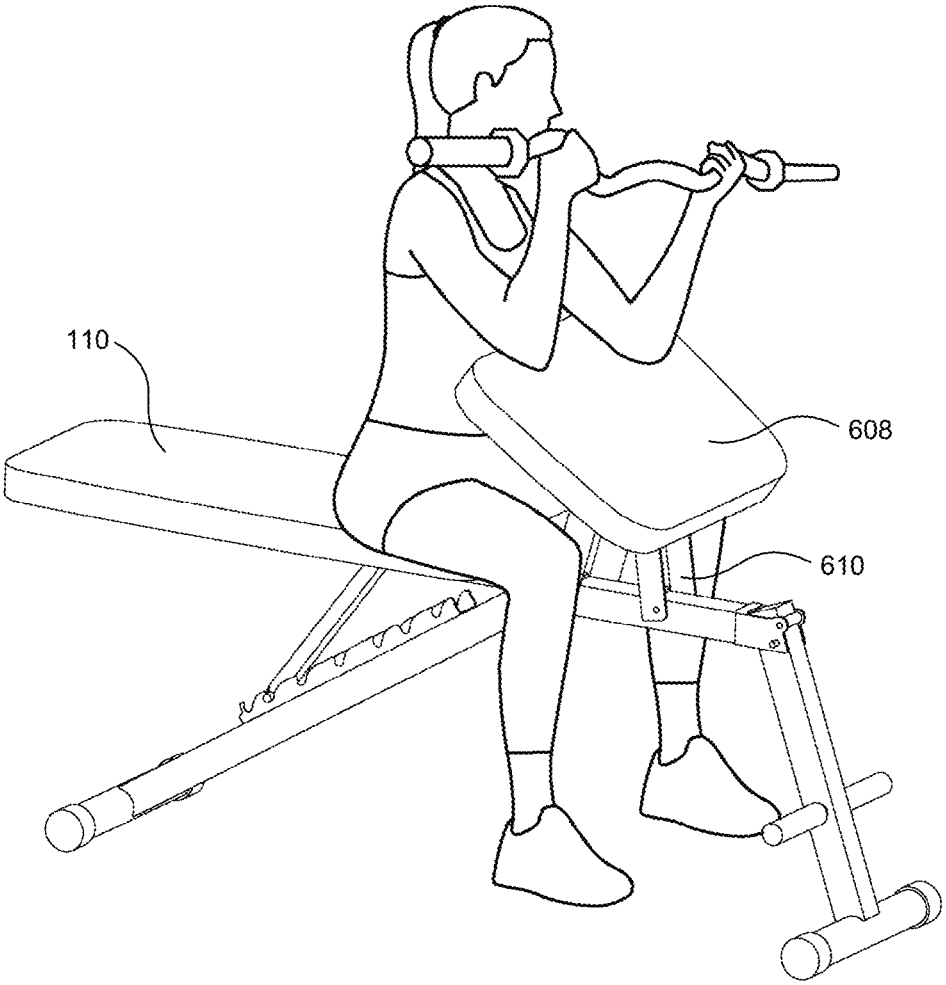
FIGS. 6A-6F illustrate an example of a foldable exercise bench with an adjustable arm rest, in accordance with aspects of the present disclosure.
Figure 6B:
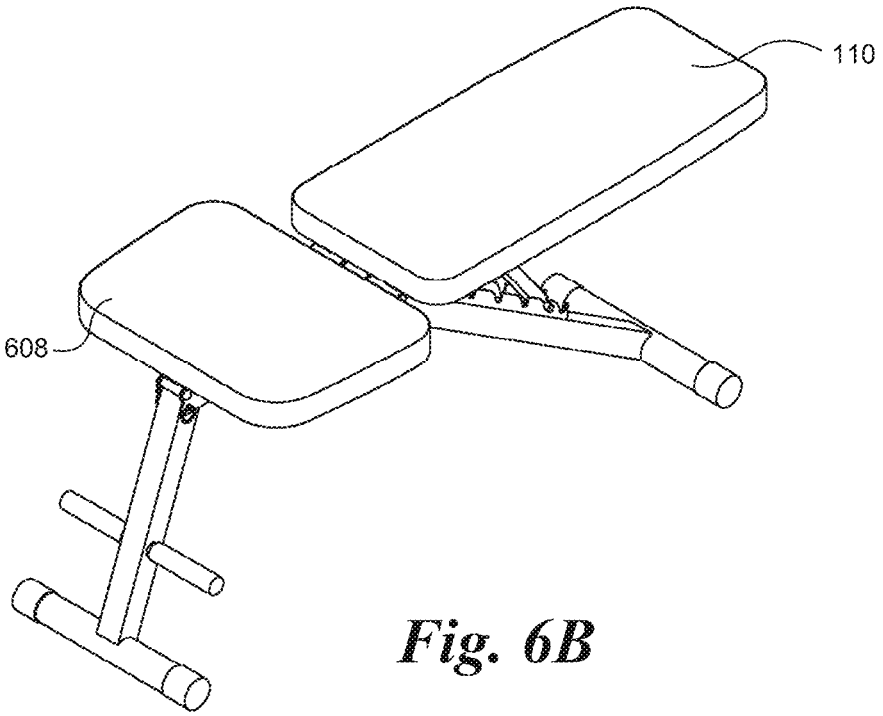
Figure 6C:
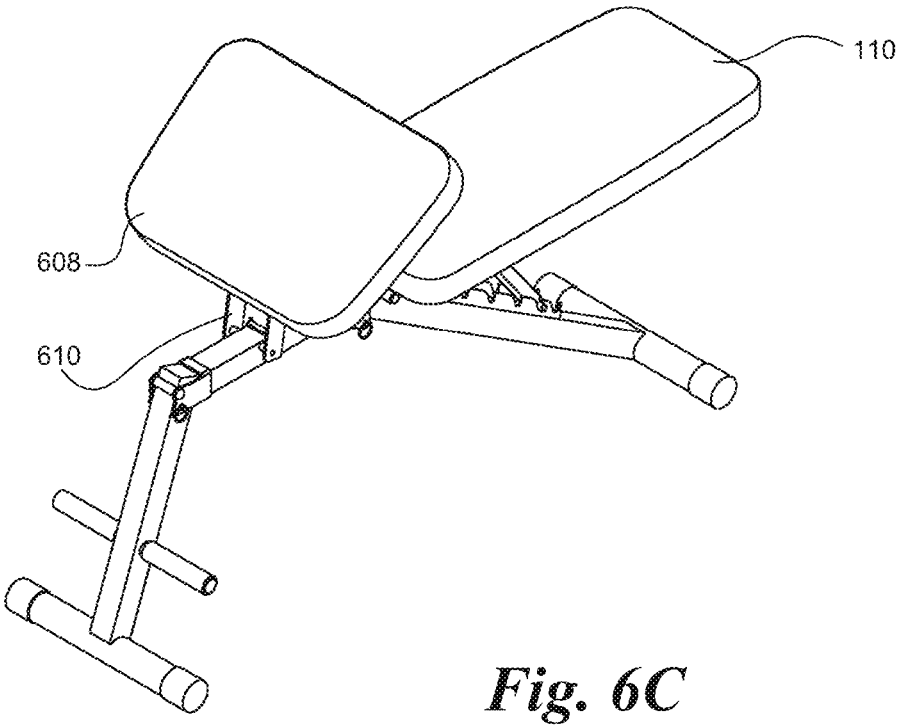
Figure 6D:
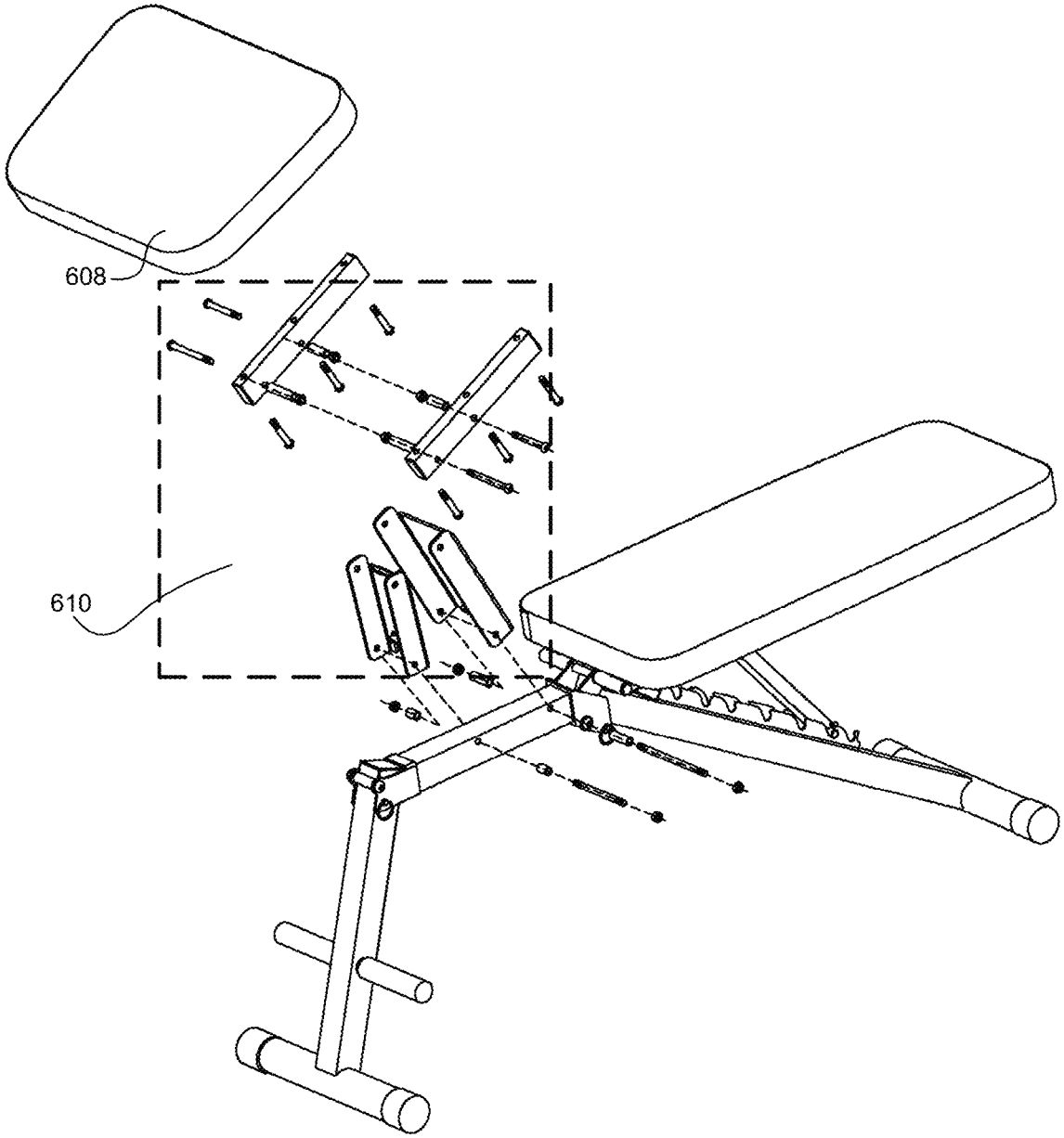
Figure 6E:
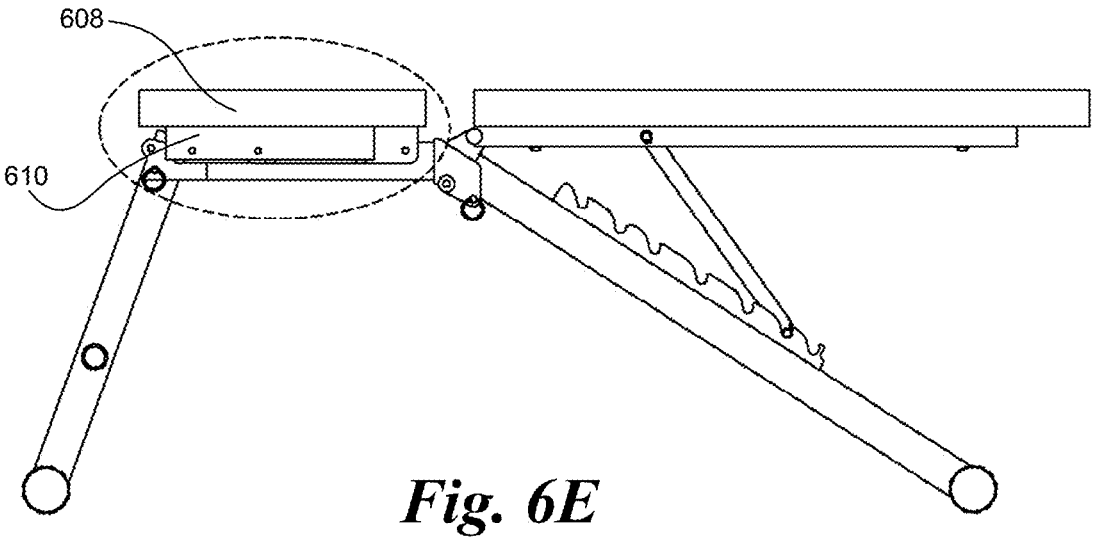
Figure 6F:
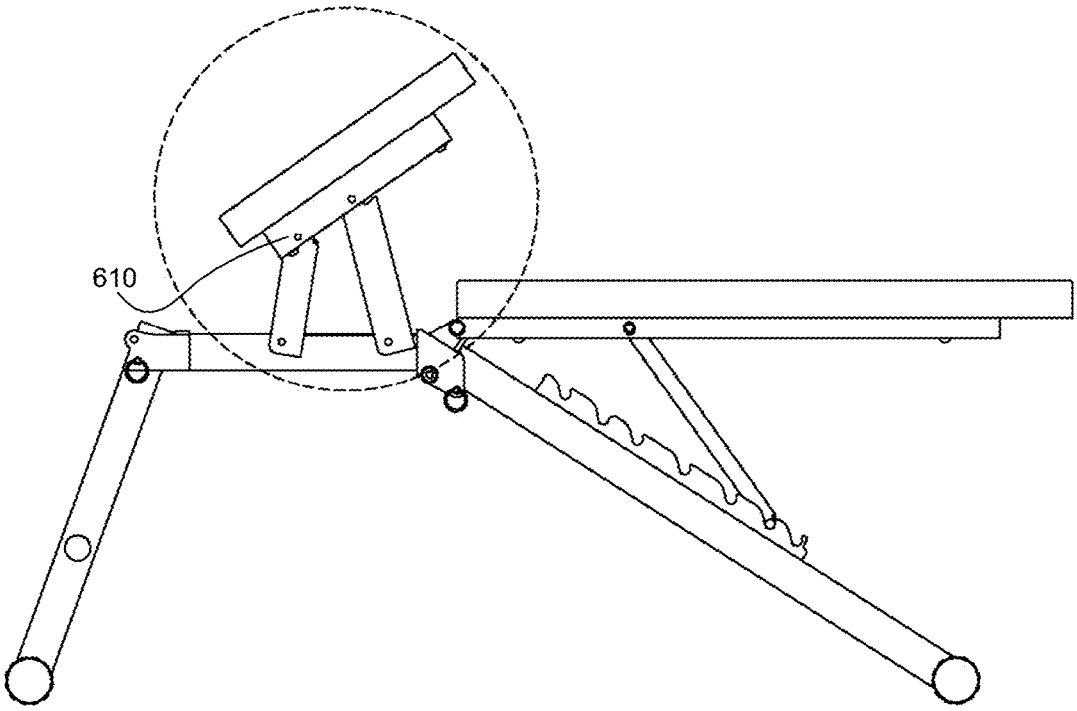

As shown in FIG. 6A, a user may deploy the arm rest 608 at the upward position. As shown in FIGS. 6A and 6B, the arm rest 608 is supported by a pivot stopping mechanism 610 that may secure the arm rest 608 at the default position and the upward position. FIG. 6D illustrates an explosive view of the pivot stopping mechanism 610. FIGS. 6E and 6F respectively illustrate side views of the pivot stopping mechanism 610 at the default position and at the upward position. The pivot stopping mechanism 610 secures the arm rest 608 at the upward position such that the arm rest 608 provides support to the user pressing against the arm rest 608 (e.g., without further movement toward the backrest 110). Details of the operation of the pivot stopping mechanism 610 are illustrated in FIGS. 7A-7D and discussed below. Numerals indicate symmetric features about the longitudinal direction. As shown, the labeled parts are symmetrical along the longitudinal direction about the center plane.

Figure 7A:
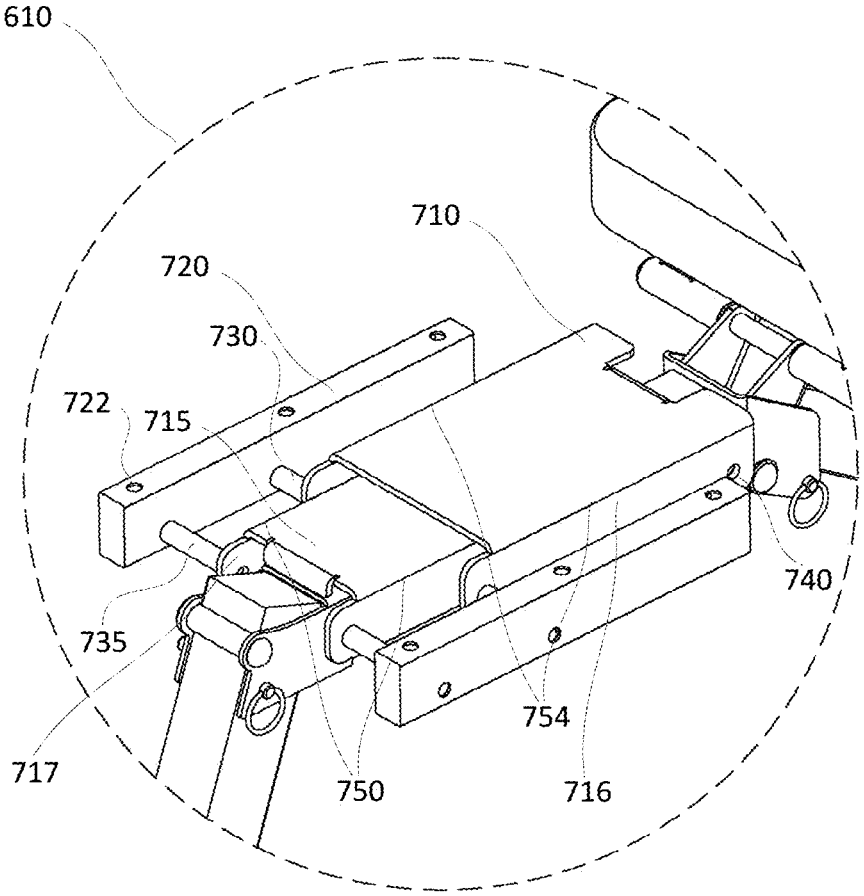
FIGS. 7A-7D illustrate details of a pivot stopping mechanism of the adjustable arm rest of FIGS. 6A-6F, in accordance with aspects of the present disclosure.
Figure 7B:
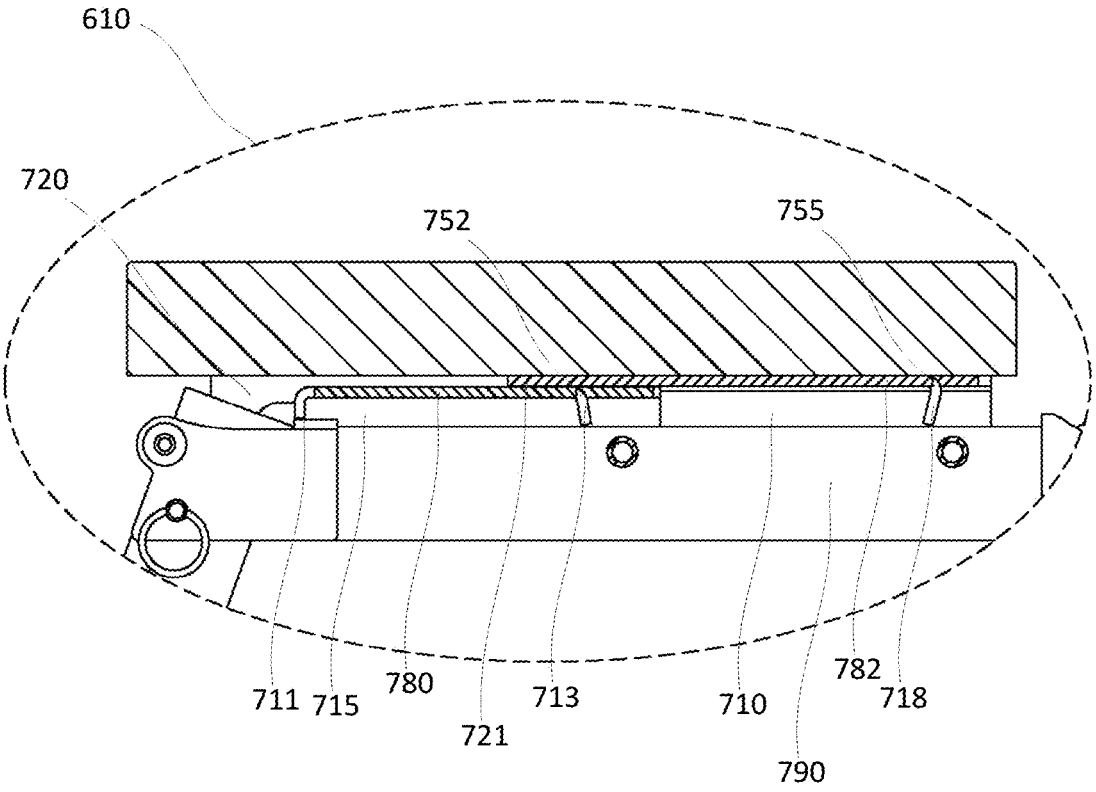

FIG. 7A illustrates the pivot stopping mechanism 610 in a perspective view without the arm rest 608 attached onto the linkage 720 (referred to the third linkage herein). FIG. 7B illustrates the local cross sectional side view of the pivot stopping mechanism 610. FIGS. 7A and 7B show the pivot stopping mechanism 610 at a first, default, position for the arm rest 608 to function as the seat 108. As shown in FIG. 7A, the linkage 720 may be made of a hollow metal tube having a number of attachment holes 722 therein. The illustrated linkage 720 has a rectangular cross section, but may have any size or shape to meet desired strength, cost, and production requirements. The linkage 720 is rotatably attached to pivots 730 and 735 (e.g., axles, pins, shafts, etc.). For example, the linkage 720 includes cavities, such as punched holes, for receiving the axles 730 and 735.

Figure 7C:
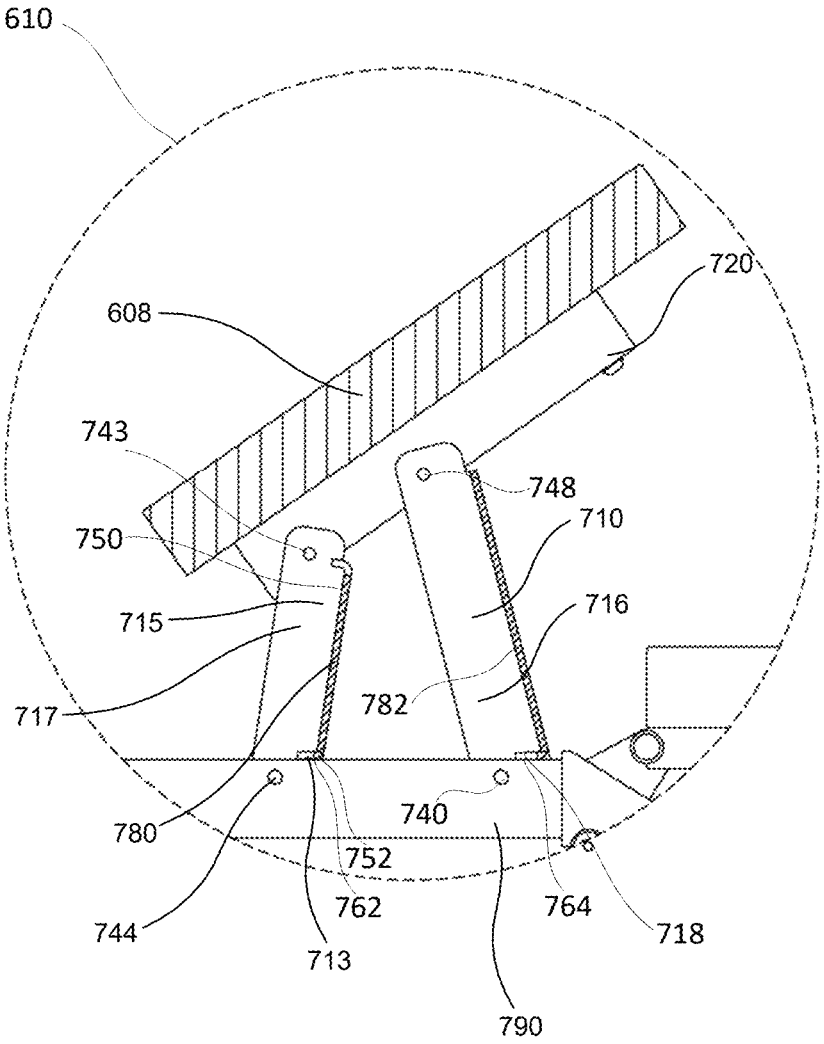

Referring to FIGS. 7A to 7C, the axle 735 is rotatably coupled with a first linkage 715. The axle 730 is rotatably coupled with a second linkage 710. The first linkage 715 and the second linkage 710 are respectively rotatably attached to the base structure 790. The first linkage 715 and the second linkage 710 may be made with a deformable sheet of materials (e.g., sheet metal) referred to as plates. The present disclosure provides processes to form pivot stopping shapes on each plate that forms the linkages to reduce cost, improve reliability, and simplify the manufacturing process by avoiding subsequent welding or assembly of multiple parts.

In FIG. 7B, at the seating position, the first linkage 715 is secured parallel to the base structure 790 by spacing with the bent tabs 711 and 713. As shown, the bent tabs 711 and 713 of the first linkage 715 engage a top surface of the base structure 790, allowing an unbent portion 780 of the plate to be spaced away from the base structure 790. The angle and length of the bent tabs 711 and 713 may be specified during manufacturing to provide a desired relative position and distance of the first linkage 715 to the base structure 790. This allows the first linkage 715 to function as a support base for the second linkage 710. As shown in FIG. 7B, the second linkage 710 includes a bent tab 716 spacing an unbent portion 782 from the base structure 790 at the same distance as that provided by the support base of the unbent portion 780 of the first linkage 715.

Figure 7D:
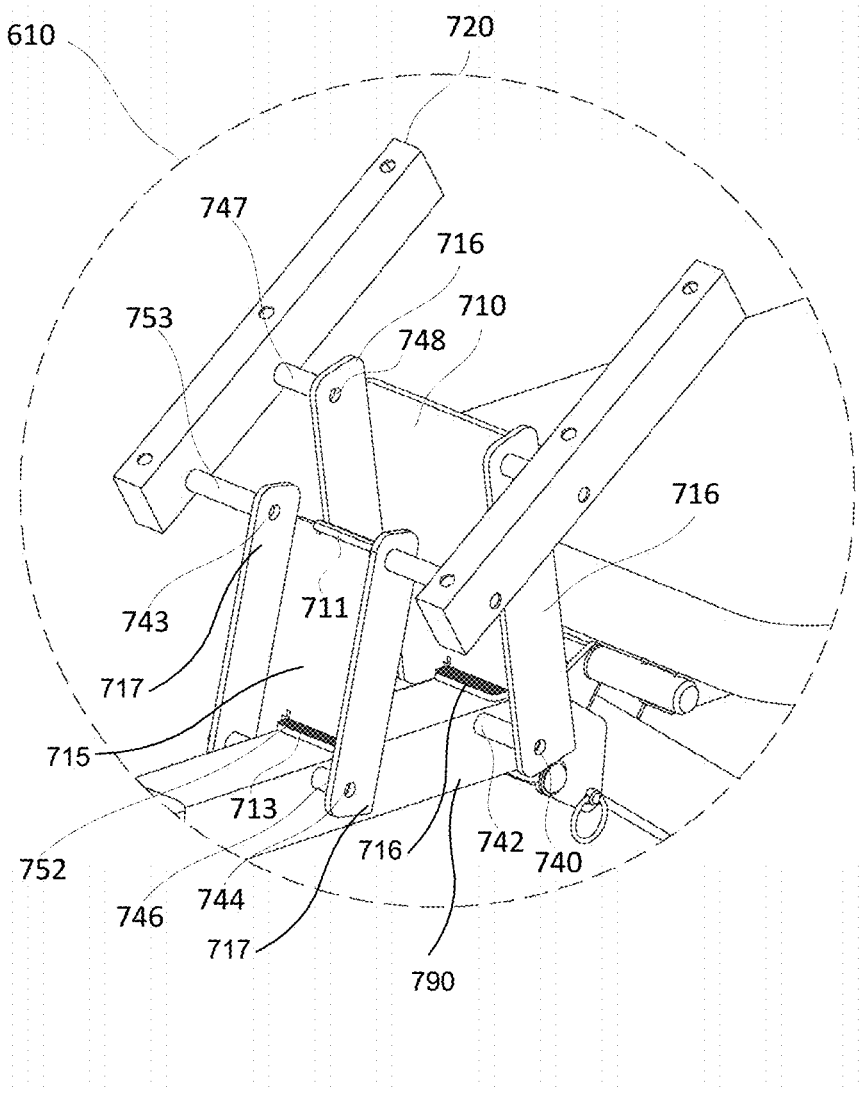

Turning now to FIGS. 7C-7D, the pivot stopping mechanism 610 is raised to a deployed position and stably secured at the position to support weights to be applied by the user. This weight supporting function and fixing the arm rest 608 at the desired position are provided by a four-bar mechanism and several tabs (e.g., pivot stoppers) bent on the linkages 715 and 710 without any assembly requirements. That is, unlike traditional rearrangements using pins or locks, the pivot stopping mechanism 610 achieves reliable and simple reconfiguration. As shown in the cross sectional side view of FIG. 7C, The first linkage 715, the second linkage 710, the base structure 790, and the third linkage 720 form a planar four-bar linkage. Usually, a four-bar linkage does not have limitations over the rotations of the links. The pivot stopping mechanism 610, however, provides the definitive (e.g., relative to the base structure 790) initial position shown in FIGS. 7A-7B and the secure deployed position shown in FIGS. 7C and 7D.

As shown in FIG. 7C, the first linkage 715 includes the first tab 717 of the first plate bent to form a first angle with the unbent portion 780 of the first plate. The first plate includes, for example, a piece of sheet metal of a uniform thickness cut and bent to form the first linkage 715. The first tab 717 forms a first crease 750 with the unbent portion 780 of the first plate and has a first cavity 744 and a second cavity 743. The first cavity 744 is rotationally engaging the first pivot 746 of the base structure 790. The second cavity 743 is rotationally engaging a third pivot 753 of the third linkage 720. The first linkage 715 is configured to rotate about the first pivot 746 between a first position corresponding to the default, seating position and a second position corresponding to the raised, arm-rest deployment position.

The first linkage 715 includes a second tab 713 of the first plate bent to form a second angle (as shown in FIG. 7C) with the unbent portion 780 of the first plate. The second tab 713 forming a second crease 752 with the unbent portion 780 of the first plate. The second crease 752 forms a non-zero angle with the first crease 750. For example, in the illustrated example, the second crease 752 is perpendicular to the first crease 750. The second tab 713 provides a first flat surface 762 for engaging the base structure 790 at the second position. For example, the flat surface 762 provides a face-to-face stopping point to prevent the first linkage 715 from further rotating towards the base structure 790. The second linkage 710 includes a similar tab for providing a similar face-to-face stopping mechanism.

As shown, the second linkage 710 includes a third cavity 740 and a fourth cavity 748. The third cavity 740 is rotationally engaging the second pivot 742 of the base structure 790. The fourth cavity 748 is rotationally engaging a fourth pivot 747 of the third linkage 720. The third linkage 720 is movable between a default position corresponding to the seating position and a set position corresponding to the deployed position, e.g., respectively corresponding to the first linkage 715 being at the first position and the second position.

In the illustrated example, the second linkage 710 is made from a second plate. Similar to the first plate, the second plate may be a piece of sheet metal of uniform thickness, cut and bent to form the second linkage 710. The second linkage 710 may include a third tab 716 of the second plate bent to form a third angle with an unbent portion 782 of the second plate. The third tab 716 forms a third crease 754 with the unbent portion 782 of the second plate. The third tab 716 has the third cavity 740 and the fourth cavity 748.

The second linkage 710 is configured to rotate about the second pivot 742 between a third position and a fourth position corresponding to the seating position and the deployed position and as limited by the fourth tab 718. The second linkage 710 includes the fourth tab 718 of the second plate bent to form a second angle with the unbent portion 782 of the second plate. The fourth tab 718 forms a fourth crease 755 with the unbent portion 782 of the second plate. The fourth crease 755 forms a non-zero angle with the third crease 754. As illustrated, the non-zero angle is a right angle. The fourth tab 718 provides a second flat surface 764 for engaging the base structure 790 at the fourth position.

In some cases, the third linkage 720 is at the set position when the first linkage 715 is at the second position and the first flat surface 762 of the second tab 713 is pressed against the base structure 790 and when the second linkage 710 is at the fourth position and the second flat surface 762 of the fourth tab 718 is pressed against the base structure 790. The third linkage 720 is at the default position when the first linkage 715 is at the first position and when the second linkage 710 is at the third position. As shown in FIGS. 7A-7B, the third linkage 720 at the default position is parallel to the first linkage 715 at the first position and the second linkage 710 at the third position. That is, in the seating position, the three linkages 710, 715, and 720 are collapsed into an aligned configuration.

As shown in FIG. 7A, wherein, when the third linkage 720 is at the default position, the third tab 716 of the second linkage 710 is closer to the third linkage 720 than the first tab 717 of the first linkage 715 is. As such, the second linkage 710 may substantially enclose the first linkage 715 for enabling the seating configuration and saving spaces.

In some cases, the first linkage 715 further includes the fifth tab 711 bent from the first plate, so that both the fifth tab 711 and the second tab 713 of the first linkage 715 limit a formation angle between the first linkage 715 and the base structure 790 when the third linkage 720 is at the default position. When the third linkage 720 is at the default position, an inner surface of the unbent portion 782 of the second plate is in contact with an outer surface 721 of the unbent portion 780 of the first plate. The second tab 713 and the fifth tab 711 of the first linkage 715 are in contact with a common plane of the base structure 790.

In some cases, when the second tab 713 of the first plate forms the second crease 752 with the unbent portion 780 of the first plate, the second crease 752 may form a non-zero angle with the first crease 750, such as to provide the pivot stopping functionality of the first linkage 715. As in the example illustrated, the first angle is a right angle.

In some cases, the second angle may be any angle greater than zero degree and less than 180 degrees but is not a right angle.

In the example as illustrated in FIGS. 7A and 7C, the second crease 752 forms a right angle with the first crease 750, allowing the first linkage 715 to rotate and is stopped against the rotation in a plane perpendicular to the pivot 735.

As described above, because the first linkage 715 and the second linkage 710 employ simple structures (e.g., cut and bent plates) to form the pivot stopping mechanism, users may operate the exercise bench 100 with ease to transform the arm-rest 608 from a seat to a weightlift supporting structure. Similar pivot stopping mechanism may be applied in the pivot stopper 124 discussed earlier, as illustrated in details in FIG. 8.

Figure 8:
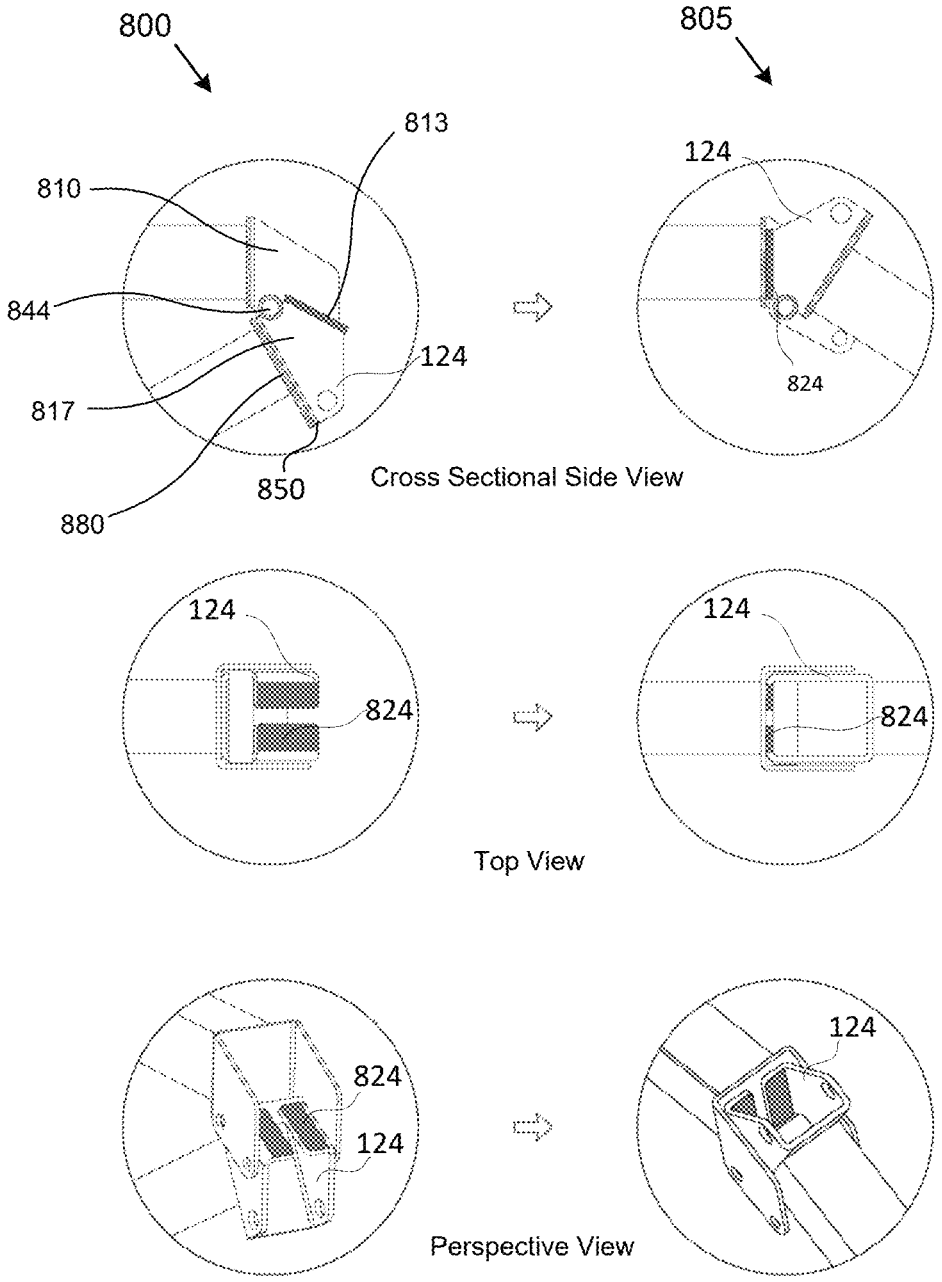
FIG. 8 illustrates details of a pivot stopper of the foldable exercise bench of FIG. 1, in accordance with aspects of the present disclosure.

FIG. 8 illustrates details of the pivot stopper 124, in accordance with aspects of the present disclosure. As shown, the column 800 illustrates the pivot stopper 124 in a cross sectional side view, a top view, and a perspective view when the pivot stopper 124 is in a transportation or storage mode. Correspondingly, the column 805 illustrates a cross sectional side view, a top view, and a perspective view of the pivot stopper in a deployed mode (e.g., as shown in FIGS. 4A-4G).

As shown, the pivot stopper 124 includes a first tab 817 of a plate (e.g., a piece of sheet metal of uniform thickness) bent to form a first angle with an unbent portion 880 the plate. The first tab 817 forms a first crease 850 with the unbent portion 880 of the plate. The first tab 817 has a cavity 844 for rotationally engaging a pivot (e.g., the rod 133) of a base structure 810 so that the pivot stopper 124 is configured to rotate around the pivot between a first position (e.g., shown in the column 800) and a second position (e.g., shown in the column 805). A second tab 813 of the plate is bent to form a second angle with the unbent portion 880 of the plate. The second tab 813 provides a flat surface 824 for engaging/contacting the base structure 810 at the second position.

In aspects, the second tab 813 of the plate is bent from and forms an angle with the first tab 817. As shown in FIG. 8, the second tab 813 forms a right angle with the first tab 813 and forms an angle with the unbent portion 880 of the plate to define the deployed angle of the rear leg 106. In some cases, the cavity 844 of the first tab 817 may be a punched hole or a drilled hole.

Figure 9:
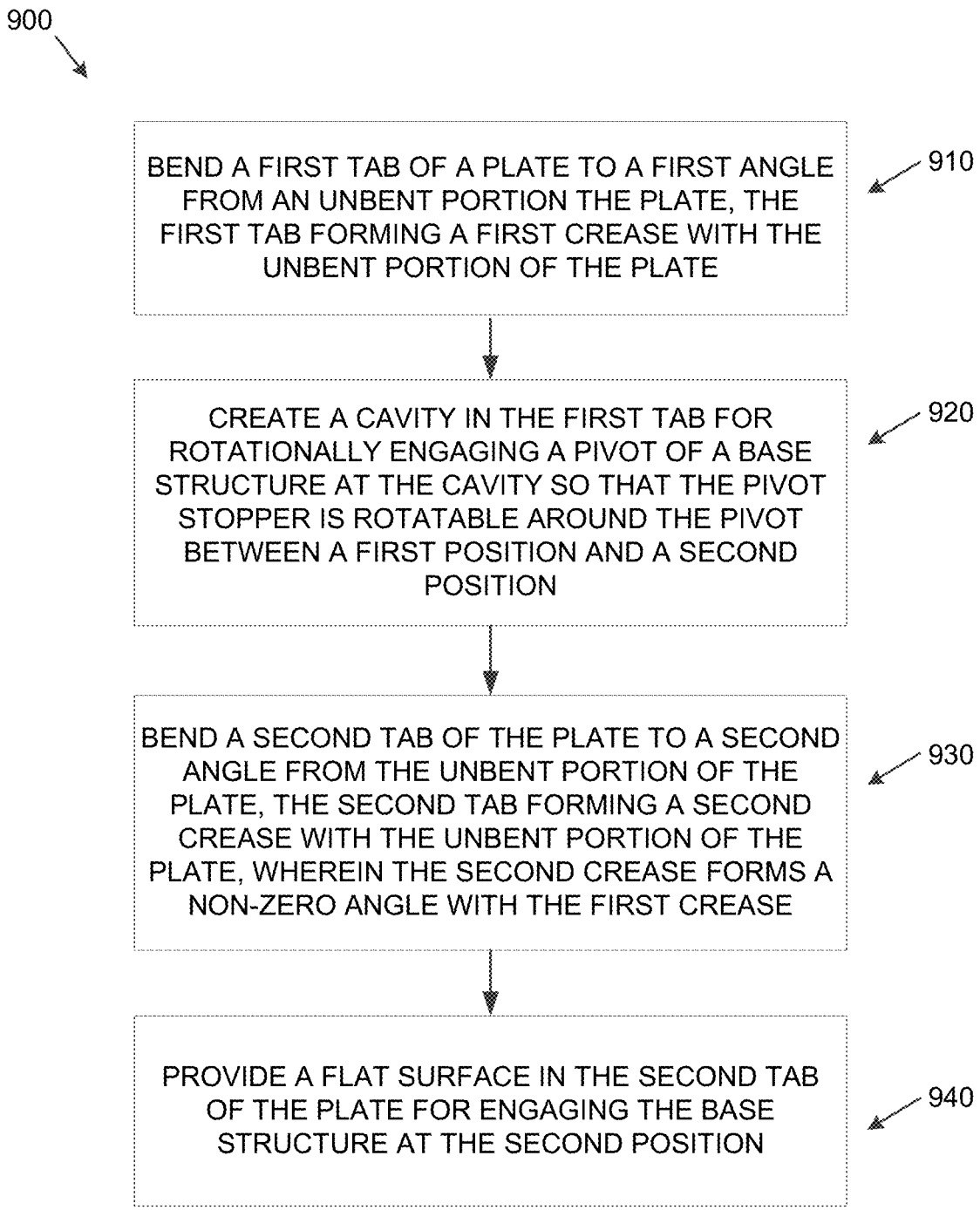
FIG. 9 is an example flow diagram of a process to produce a pivot stopper, in accordance with aspects of the present disclosure.

FIG. 9 is an example flow diagram of a process 900 to produce a pivot stopper, such as one of the first linkage 715, the second linkage 710, or the pivot stopper 124, in accordance with aspects of the present disclosure.

The process 900 begins, at 910 by bending a first tab of a plate to a first angle from an unbent portion the plate. The first tab forms a first crease with the unbent portion of the plate.

At 920, a cavity in the first tab is created for rotationally engaging a pivot of a base structure at the cavity so that the pivot stopper is rotatable around the pivot between a first position and a second position.

At 930, a second tab of the plate is bent to a second angle from the unbent portion of the plate. The second tab forming a second crease with the unbent portion of the plate, wherein the second crease forms a non-zero angle with the first crease.

At 940, a flat surface in the second tab of the plate is provided for engaging the base structure at the second position.

In aspects, bending the first tab and the second tab of the plate further includes at least one of: press forming the plate to simultaneously bend the first tab and the second tab; roll forming the plate to sequentially bend the first tab and the second tab in either order; punching on respective dies to form the first tab and the second tab; performing a three-point bending to form each of the first tab and the second tab; or folding the first tab at the first crease from the unbent portion the plate and folding the second tab at the second crease from the unbent portion of the plate.

In aspects, creating the cavity in the first tab comprises at least one of: punching a through-hole as the cavity; drilling a through-hole as the cavity; or pressing a protrusion from the first tab.

In aspects, the first angle is a right angle and the second angle is greater than zero degrees but less than 180 degrees. In some cases, the second crease forms a right angle with the first crease.

The above description of embodiments is not intended to be exhaustive or to limit the invention to the described forms. Specific embodiments of, and examples for, the invention are described herein for illustrative purposes, but various modifications are possible.

What is claimed is:

1. A linkage mechanism comprising:

a base structure having a first pivot and a second pivot;

a first linkage made from a first plate, the first linkage comprising:

a first tab of the first plate bent to form a first angle with an unbent portion of the first plate, the first tab forming a first crease with the unbent portion of the first plate and having a first cavity and a second cavity, the first cavity rotationally engaging the first pivot of the base structure and the second cavity rotationally engaging a third pivot of a third linkage, wherein the first linkage is configured to rotate about the first pivot between a first position and a second position; and a second tab of the first plate bent to form a second angle with the unbent portion of the first plate, the second tab forming a second crease with the unbent portion of the first plate, wherein the second crease forms a non-zero angle with the first crease and wherein the second tab provides a first flat surface for engaging the base structure at the second position;

a second linkage comprising a third cavity and a fourth cavity, the third cavity rotationally engaging the second pivot of the base structure and the fourth cavity rotationally engaging a fourth pivot of the third linkage; and the third linkage movable between a default position and a set position respectively corresponding to the first linkage being at the first position and the second position.

2. The linkage mechanism of claim 1, wherein the second linkage is made from a second plate, and wherein the second linkage comprises:

a third tab of the second plate bent to form a third angle with an unbent portion of the second plate, the third tab forming a third crease with the unbent portion of the second plate and having the third cavity and the fourth cavity, wherein the second linkage is configured to rotate about the second pivot between a third position and a fourth position; and a fourth tab of the second plate bent to form a second angle with the unbent portion of the second plate, the fourth tab forming a fourth crease with the unbent portion of the second plate, wherein the fourth crease forms a non-zero angle with the third crease and wherein the fourth tab provides a second flat surface for engaging the base structure at the fourth position.

3. The linkage mechanism of claim 2, wherein the third linkage is at the set position when the first linkage is at the second position and the first flat surface of the second tab is pressed against the base structure and when the second linkage is at the fourth position and the second flat surface of the fourth tab is pressed against the base structure.

4. The linkage mechanism of claim 3, wherein the third linkage is at the default position when the first linkage is at the first position and when the second linkage is at the third position, and wherein the third linkage at the default position is parallel to the first linkage at the first position and the second linkage at the third position.

5. The linkage mechanism of claim 4, wherein, when the third linkage is at the default position, the third tab of the second linkage is closer to the third linkage than the first tab of the first linkage is.

6. The linkage mechanism of claim 4, wherein the first linkage further comprises a fifth tab bent from the first plate, wherein both the fifth tab and the second tab of the first linkage limit a formation angle between the first linkage and the base structure when the third linkage is at the default position.

7. The linkage mechanism of claim 6, wherein, when the third linkage is at the default position, an inner surface of the unbent portion of the second plate is in contact with an outer surface of the unbent portion of the first plate, and wherein the second tab and the fifth tab of the first linkage are in contact with a common plane of the base structure.

8. The linkage mechanism of claim 1, wherein the first angle is a right angle and wherein the second angle is greater than zero degrees and less than 180 degrees but is not a right angle.

9. The linkage mechanism of claim 1, wherein the second crease forms a right angle with the first crease.

10. The linkage mechanism of claim 1, wherein at least one of the first, the second, the third, or the fourth cavity comprises a punched hole or a drilled hole.

* * * * *